United States Patent [19]

Gutschmit et al.

[11] Patent Number: 4,537,048

[45] Date of Patent: Aug. 27, 1985

[54] PILE LOOP FORMING AND CUTTING ELEMENTS FOR CIRCULAR KNITTING MACHINES

[75] Inventors: Alan Gutschmit, Troy; Paul W. York, Asheboro, both of N.C.

[73] Assignees: Monarch Knitting Machinery Corp., Glendale, N.Y.; Monatex S.A., Neuchatel, Switzerland

[21] Appl. No.: 515,690

[22] Filed: Jul. 21, 1983

Related U.S. Application Data

[60] Division of Ser. No. 213,872, Dec. 8, 1980, Pat. No. 4,409,800, which is a continuation-in-part of Ser. No. 905,021, May 11, 1978, abandoned.

[51] Int. Cl.[3] ..... D04B 35/02; D04B 9/12

[52] U.S. Cl. ..... 66/93

[58] Field of Search ..... 66/61, 91, 92, 93, 123

[56] References Cited

U.S. PATENT DOCUMENTS

| | | | |
|---|---|---|---|
| 2,335,075 | 11/1943 | Needham | 66/123 X |
| 4,026,126 | 5/1977 | Nuber | 66/92 X |

FOREIGN PATENT DOCUMENTS

| | | | |
|---|---|---|---|
| 618594 | 9/1935 | Fed. Rep. of Germany | 66/91 |
| 988865 | 4/1965 | United Kingdom | 66/93 |
| 118149 | 4/1958 | U.S.S.R. | 66/93 |
| 127781 | 3/1959 | U.S.S.R. | 66/92 |
| 441366 | 5/1975 | U.S.S.R. | 66/91 |

*Primary Examiner*—Wm. Carter Reynolds

*Attorney, Agent, or Firm*—Richards, Shefte & Pinckney

[57] ABSTRACT

A process and apparatus for producing knitted cut-pile fabric on a conventional circular knitting machine having a cylinder containing conventional latch needles and a dial containing dial elements each having a hook, a yarn cutting edge spaced from the hook and a yarn supporting surface extending therebetween, each dial element being radially movable between adjacent cylinder needles. Body yarn is progressively fed to the cylinder needles and pile yarn is progressively fed to the needles and the dial elements, the needles and dial elements being manipulated to form stitches of body yarn on the needles, to associate the pile yarn in the stitches and form pile loops on the dial elements, and to cast-off the needles the associated stitches and pile yarn to anchor the pile yarn in the stitches. The pile loops are retained and distended on the dial elements with their hooks and, subsequent to the casting off of the associated stitches and pile yarn, the dial elements are manipulated to advance their cutting edges against the retained pile loops, thereby cutting the pile loops to form cut-pile ends. A presser bar is provided for clamping the retained pile loops against the outer circumferential surface of the dial during the cutting thereof by the dial elements. A guide wire is also provided to guide the cut pile ends progressively radially inwardly of the cylinder after the cutting thereof. A fabric may be produced having alternate courses formed in loops in alternate wales and float stitches across intermediate wales, and intermediate courses formed in loops in intermediate wales and float stitches across alternate wales with cut ends of the pile loop forming yarn projecting from the fabric face from each side of each alternate and intermediate course loop.

6 Claims, 49 Drawing Figures

Fig. 2
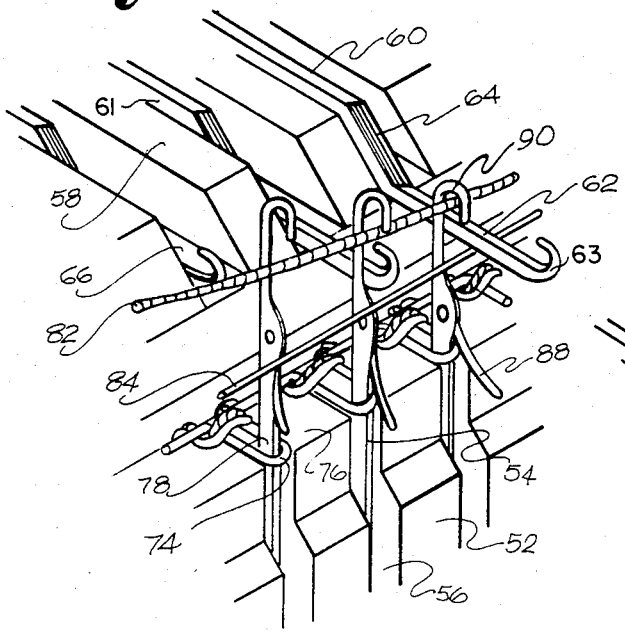
Fig. 3
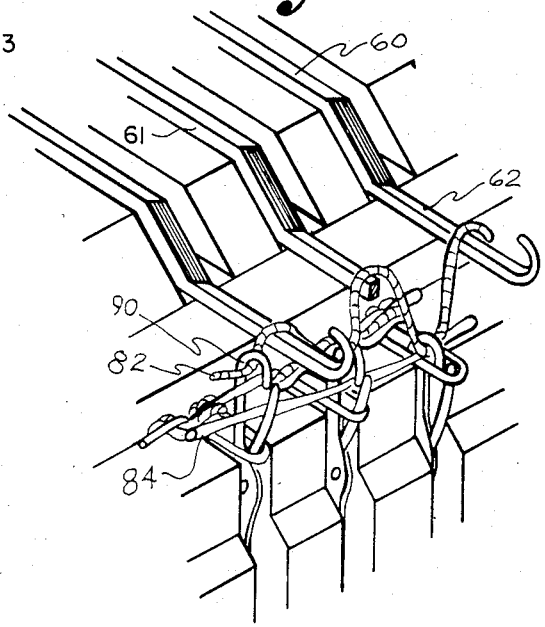
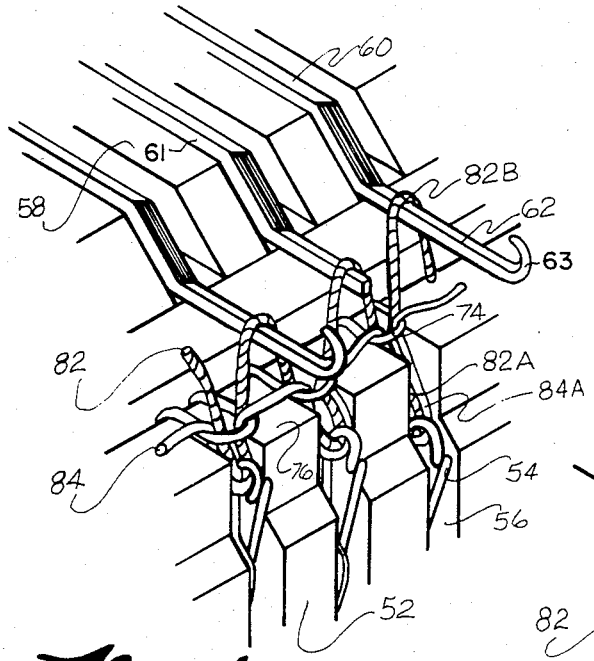
Fig. 4
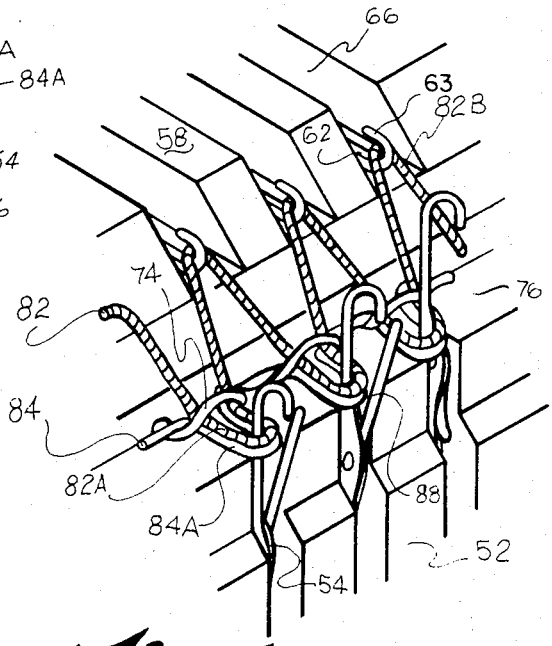
Fig. 5

Fig. 6
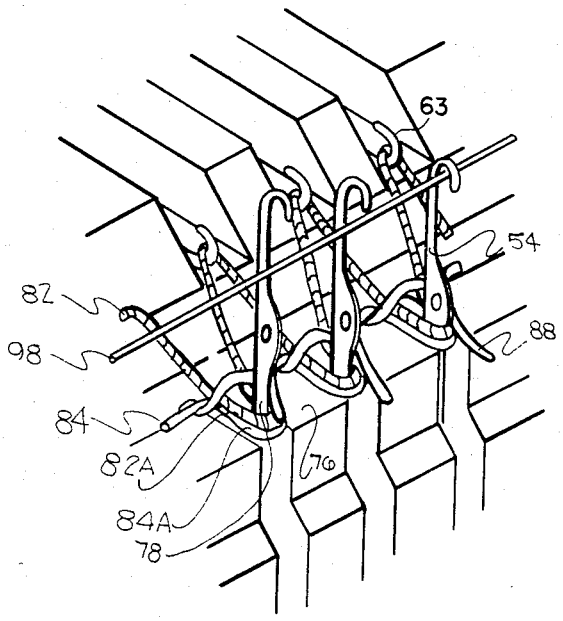
Fig. 7
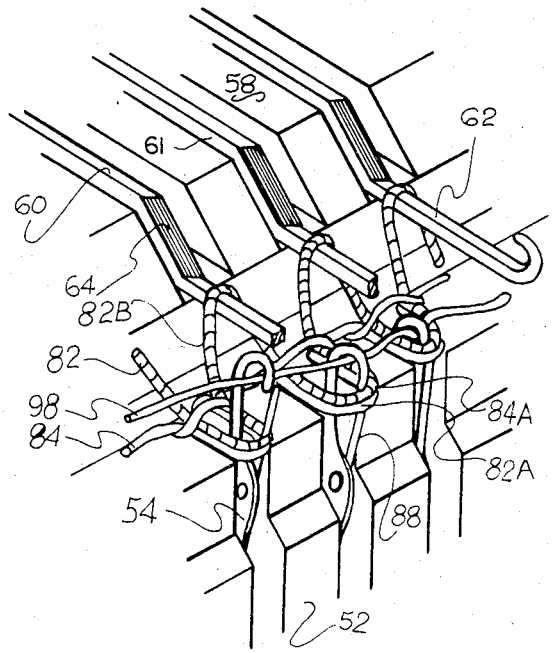
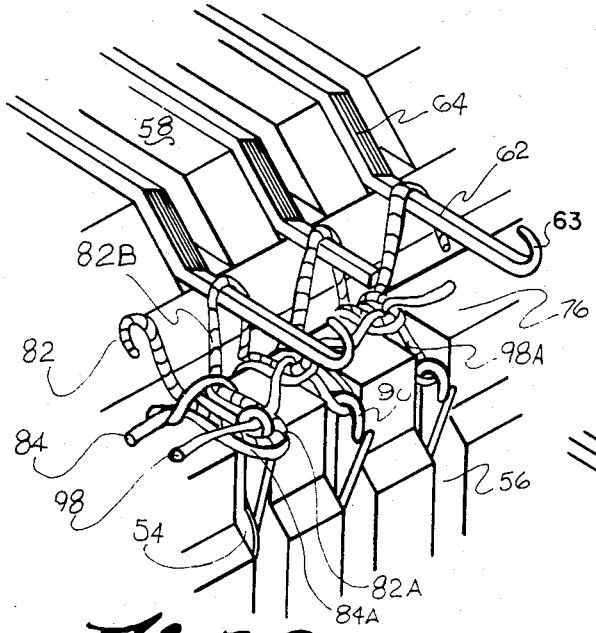
Fig. 8
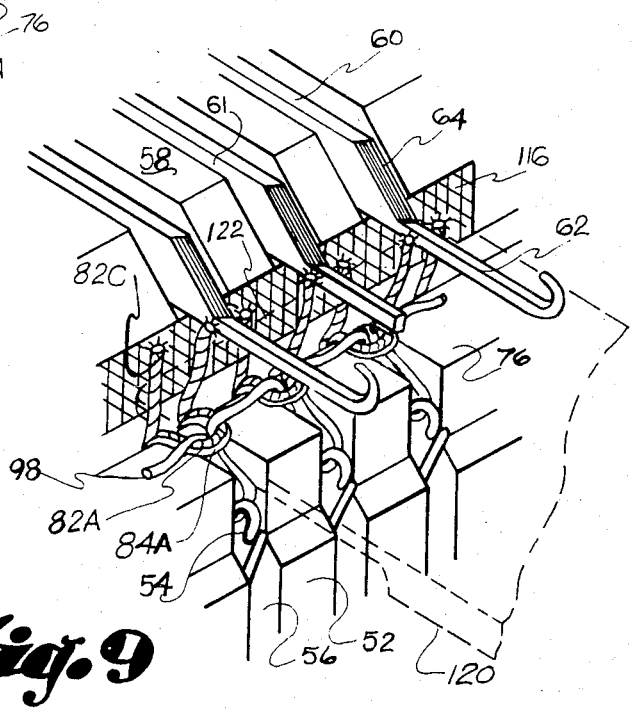
Fig. 9

Fig. 10
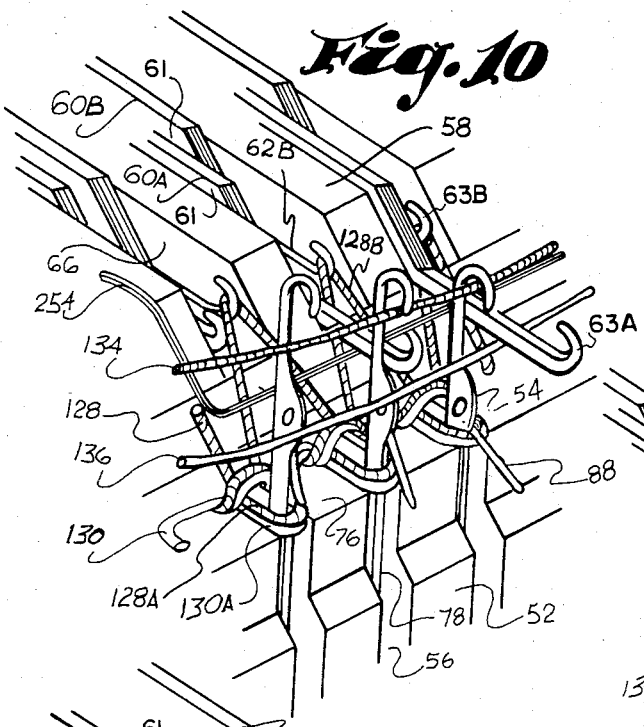
Fig. 11
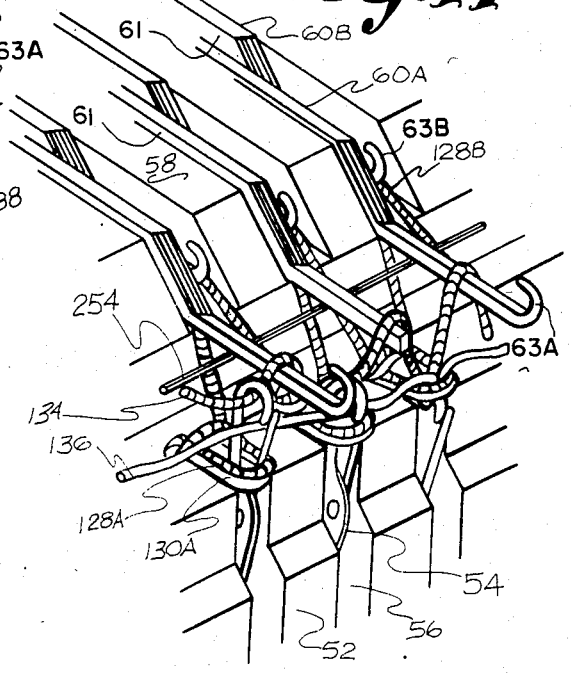
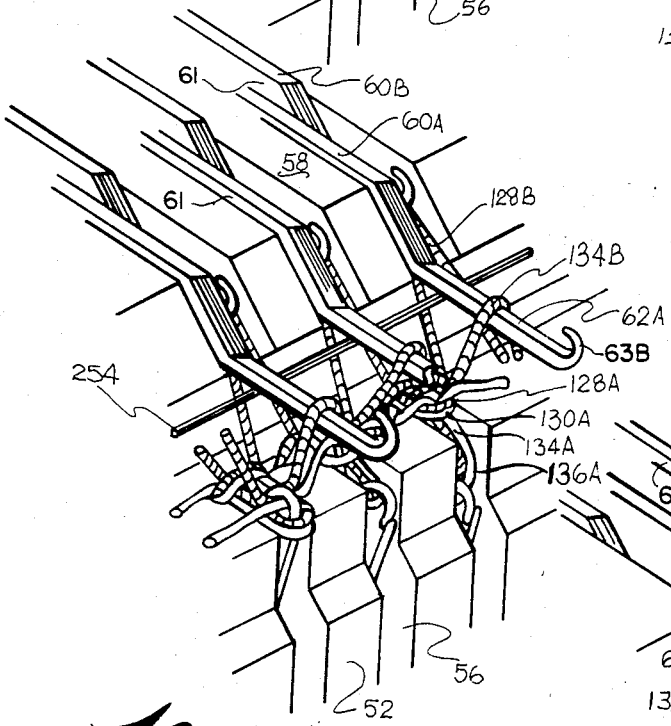
Fig. 12
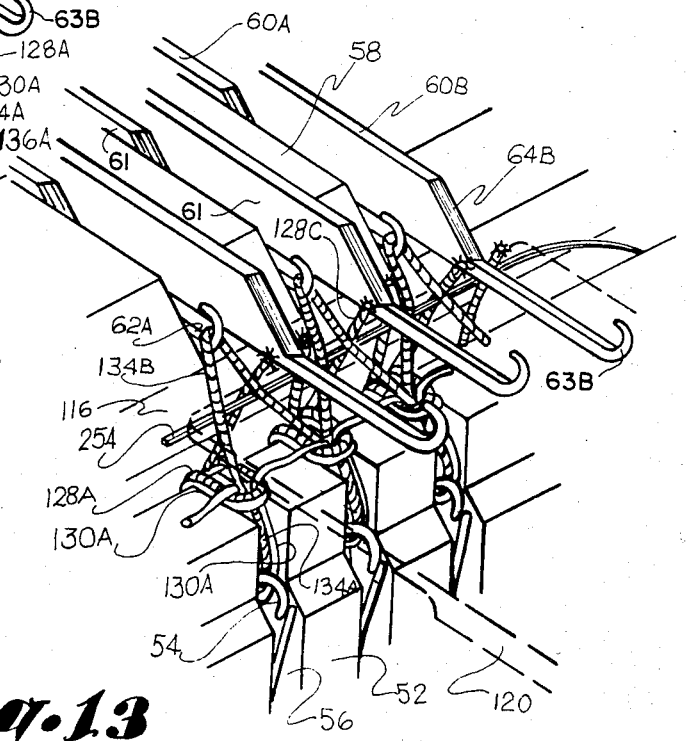
Fig. 13

PILE LOOP FORMING AND CUTTING ELEMENTS FOR CIRCULAR KNITTING MACHINES

CROSS REFERENCE TO OTHER APPLICATIONS

This application is a division of co-pending U.S. patent application Ser. No. 213,872, filed Dec. 8, 1980 now issued as U.S. Pat. No. 4,409,800, which is a continuation-in-part of U.S. patent application Ser. No. 905,021, filed May 11, 1978, now abandoned.

BACKGROUND OF THE INVENTION

Many forms of cut-pile knitted fabric are known and produced in the textile industry. One of the most popular forms of this type of fabric is knitted velour, a plush knit construction produced by knitting two yarns in plating relationship, one yarn forming pile loops which appear on the plush surface of the fabric and the other yarn forming the base or body of the fabric. In other conventional forms of cut-pile fabric, the pile yarn, rather than actually being knitted with the base or body yarn, is inlaid or otherwise incorporated unknit in the base or body fabric. Cut-pile fabrics of these types are conventionally produced on circular knitting machines utilizing a cylinder of knitting needles in conjunction with specially constructed pile loop forming sinkers. Thus, for example, velour has traditionally been produced on circular knitting machines using specially constructed sinkers capable of forming loops on two levels. Two yarns are fed to the knitting needles, the yarn which is to form the plush or pile loops being fed over the top loop forming level of the sinker and the base yarn being fed over the lower loop forming level. In this manner, loops of two different heights are created, the shorter loops forming the base and appearing on the plain side of the finished fabric and the longer loops forming the surface or pile loops which appear on the purl side of the finished fabric. The above-mentioned pile fabric having an inlaid pile yarn is similarly produced, except that the pile yarn is fed and manipulated in such a manner that it is incorporated unknit in the stitches of the body fabric.

As will be understood, the knitted fabrics produced by the above-described methods contain uncut pile loops, which must be further processed after knitting is completed to produce cutpile ends by shearing of the longer surface pile loops, i.e. cutting off the top portion of each pile loop thereby leaving two cut-pile ends extending outwardly from the fabric surface and being anchored in the base by virtue of having been knit in plating relationship with the base yarn, inlaid in the body fabric or otherwise incorporated therein. Brushing or napping of the fabric may be performed either for the purpose of breaking the surface loops, thus serving as a substitute for shearing, or as an additional step subsequent to shearing to raise the individual fibers in the cut ends to enhance the plush surface effect and feel of velour. Tigering may also be desirable to remove surplus fiber strands from the napped fabric surface.

Although the foregoing known methods produce desirable results, there are significant disadvantages. Substantial labor and production costs are inherently involved in performing the finishing steps of shearing, brushing and tigering and there is a significant fiber waste resulting from the shearing and napping procedures. In fact, in conventional velour production as much as 20–25% of the pile yarn knitted is sheared and thrown away. The percentage is significantly higher in the production of other forms of cut-pile fabric in which the pile yarn is inlaid or otherwise incorporated in the base fabric unknit since the pile loops comprise most of the pile yarn employed in such knitting. Compounding this problem is the fact that the shearing process involves the risk of failing to shear some of the plush loops, especially when one is attempting to reduce the amount of fiber waste by shearing at a reduced nap depth. Because of this, it is often necessary to perform the shearing step twice to achieve first quality cut-pile fabric. Alternatively, the danger of damaging the fabric exists when shearing is performed at a greater nap depth or more than once in an attempt to insure the shearing of all pile loops. A still further disadvantage is that, because of the necessary shearing step in producing velour, polyester velour generally cannot feasibly be produced due to the excessive dulling effect that polyester yarn has on the shearing blades of the typical shearing machine. Finally, in conventional cut-pile fabric knitting, great attention must be paid to the nature of the pile loops formed and to the type of yarn used to form the pile loops since the torque of the pile yarn can cause significant problems in shearing the pile loops. If the torque or twist of the pile yarn is too great, the pile loops will tend to spiral after leaving the loop forming sinkers. This spiraling effect makes shearing of the pile loops more difficult in that the loops themselves become harder to shear and in that the loops are less prone to extend outwardly from the fabric surface thereby increasing the likely number of unsheared loops.

In contrast, the present invention provides a novel method and apparatus for producing cut-pile fabric in which the pile loops of the fabric are cut at the top of each loop during the knitting cycle. The shearing step may be entirely eliminated, while at the same time virtually no fiber waste is involved thereby greatly reducing production costs. While shearing of the cut-pile fabric produced by the present invention may sometimes be desirable as a cleaning step, only one shearing would be necessary and only approximately 5% of the pile yarn would be cut and thrown away. As a result, a more expensive pile yarn may be utilized in the present invention without increasing the cost of fabric production. Additionally, under the present invention every loop is cut, thereby substantially eliminating unsheared loops as a cause of defective cloth. Since the pile loops are cut at the crest of each loop, the size of the pile loop which must be formed to achieve the same pile height as produced on conventional machines is also decreased, thereby allowing still further reductions in the amount of yarn used. On the other hand, because less loop yarn is cut away in the finishing procedures by using the invention herein described, the resultant cut ends may be made significantly higher if desired without increasing production costs. Additionally, fabric producers are no longer limited to utilizing cotton yarns since, according to the present invention, the dulling effect involved in the cutting of synthetic fibers is greatly reduced. Finally, since the pile loops are cut during the knitting operation and before any twisting or spiraling of the loops occurs, the torque of the pile yarn becomes immaterial, thus a wider range of yarn types may be used in employing the present invention.

By virtue of performing the cutting operation during the knitting operation, it also becomes feasible to produce knitted cut-pile fabric in patterns other than the plain jersey pattern conventionally used. For conventional cut-pile fabric production, in order to properly shear the pile loops of the knitted fabric, it is necessary that the loops extend substantially perpendicularly from the fabric surface to facilitate uniform shearing and, therefore, a high density of pile loops in the knitted fabric is desirable, if not necessary, for successful shearing, the high density of loops giving greater lateral support to the pile loops. Because of this, a single or plain jersey stitch pattern is used almost exclusively in conventional cut-pile fabric production in order to achieve maximum pile loop density. In contrast, since, according to the present invention, pile loops are cut during the knitting operation, the density of the pile of the knitted fabric is not a limiting factor. Thus, a much wider variety of stitch patterning becomes available to the knit fabric producer in employing the present invention. It therefore becomes possible to produce cut-pile fabrics using stitch patterns employing significantly fewer needles per inch than plain jersey or stitch patterns in which only selected needles participate in the knitting of any one course. As a result, much weaker yarns or yarns with a softer twist may be used to form the pile loops since a lesser number of needles will be acting on the pile yarn at any one time. On the other hand, considerably higher pile loops may be formed than is possible using a plain jersey stitch pattern since the number of needles putting tension on the pile loops will be reduced. A softer plusher fabric is therefore possible. Additionally, by employing heretofore unconventional stitch patterns in producing cut-pile fabric, surface color effects (e.g. a tweed effect) may be achieved merely by employing different color pile yarns. In contrast, only coursewise stripe effects may be produced in using different color yarns in a jersey pattern.

SUMMARY OF THE INVENTION

The present invention provides a method and apparatus for producing knitted cut-pile fabric on a conventional circular knitting machine having a cylinder containing a plurality of cylinder needles and a dial containing a plurality of dial elements radially movable between the cylinder needles, each of the dial elements having a yarn engaging hook, a yarn cutting edge spaced from the hook, and a yarn supporting surface extending therebetween. Briefly describing the present invention, body yarn is progressively fed to the needles and pile yarn is progressively fed to the needles and dial elements, and the needles and dial elements are progressively manipulated respectively transversely by respective camming means to engage and manipulate the body and pile yarns to form knit fabric courses having stitches of the body yarn, having the pile yarn associated and anchored in the body yarn stitches, and having pile loops of the pile yarn extending therefrom. According to the present invention, the camming means is arranged to manipulate the needles and dial elements to form stitches of the body yarn on the needles, to associate the pile yarn with the body yarn stitches and form pile loops of the pile yarn on the dial elements, and to cast off the needles the body yarn stitches and the associated pile yarn to anchor the pile yarn in the body yarn stitches while distending and retaining the pile loops on the dial elements with the hooks thereof. The camming means is further arranged to periodically further manipulate the dial elements transversely of the needles to cause the cutting edges of the dial elements to sever the retained pile loops subsequent to the casting off of the pile yarn and the body yarn stitches in which the pile yarn is anchored, thereby to form cut-pile ends.

According to one feature of the present invention, a presser bar is provided radially outwardly of the dial at every cutting station on the circular knitting machine to clamp the pile loops formed and retained on the dial elements against the dial of the knitting machine at a location below the dial elements during the radially outward cutting movement of the dial elements thereby to maintain the pile loops in effective position for severance by the cutting edges of the dial elements. In this manner, fabric distortion which might result from pulling of the pile loops by the dial elements as they move outwardly is prevented and, further, the dulling effect of the cutting operation on the cutting edges of the dial elements is decreased.

In three specific embodiments of the present invention, the pile yarn is associated with the body yarn stitches by forming stitches of the pile yarn in plating relationship with the body yarn stitches. According to these embodiments, the camming means raises the cylinder needles and moves the dial elements radially outwardly to respective yarn receiving positions. A pile yarn and a body yarn are then fed simultaneously to the cylinder needles, the pile yarn being fed above the yarn supporting surfaces of the dial elements and the body yarn being fed below the dial elements. The cylinder needles are then moved downwardly from their yarn receiving position by the camming means, drawing both yarns into the hooks of the needles and drawing needle loops of each yarn through the needle loops of the previously formed course, the pile yarn being retained on the yarn supporting surfaces of the dial elements during the needle movement, thereby effecting the formation of a pile loop on each dial element. Subsequently, the dial elements are withdrawn by the camming means radially inwardly between the needles from the yarn receiving position to a pile loop retaining position for distention and retention of the pile loops on the dial elements with the hooks thereof, and another yarn is fed and knitted by the needles to effect the casting off from the needles of the associated needle loops of the pile and body yarn in the same course as the retained pile loops. Once the needle loops of the body and pile yarn have been cast off from the needles, the dial elements are moved radially outwardly by the camming means to advance the cutting edges of the dial elements against the pile loops retained thereon, thereby severing the pile loops at their crest to form cut-pile ends.

According to one of the above-mentioned three specific embodiments of the present invention, the casting off of the needle loops of the associated pile and body yarns is performed by knitting a single jersey course of body yarn subsequent to the aforementioned formation of plated stitches of pile and body yarns.

According to a second of the three specific embodiments, the dial elements are arranged in pairs, with each pair being radially movable between adjacent cylinder needles. In practicing this embodiment, two yarns are fed to and knitted by each cylinder needle as aforementioned, forming pile loops over the first dial element of each pair of dial elements while the other dial element is out of action. The pile loops are then retained on the first dial elements, while two yarns are fed to and knitted by each cylinder needle, forming pile loops over the second dial element of each pair of dial elements and casting off the needle loops formed by the first double yarn course. The first dial elements are then moved radially outwardly to advance the cutting edges thereof against the pile loops formed thereover and retained thereon, thereby cutting the pile loops to form cut pile ends. In each succeeding cycle, the pile loops of the second double yarn course are retained on the second dial elements of each pair of dial elements until the knitting of the first double yarn course is completed thereby casting off the needle loops formed by the second double yarn course, at which time the second dial elements are moved radially outwardly to advance the cutting edges thereof against the pile loops formed thereover and retained thereon.

In accordance with the third of the three specific embodiments, alternate cylinder needles are formed with commonly located control butts and intermediate cylinder needles are formed with other commonly located control butts; alternate dial elements are formed with commonly located control butts and intermediate dial elements are formed with other commonly located control butts. In practicing this embodiment, two yarns are fed to and knitted by each alternate cylinder needle as aforementioned, i.e. one yarn being fed above the dial elements and one below, forming first pile loops over each alternate dial element. While the first pile loops are retained over the alternate dial elements, two yarns are fed to and knitted by each intermediate needle in the same manner, forming second pile loops over the alternate dial elements. While retaining both the first and the second pile loops on the alternate dial elements, two yarns are fed to and knitted by each alternate needle, forming third pile loops over the intermediate dial elements and casting off the needle loops formed by the alternate needles in the first double yarn course. While retaining the first and second pile loops over the alternate dial elements and the third pile loops over the intermediate dial elements, two yarns are fed to and knitted by each intermediate needle, forming fourth pile loops over the intermediate dial elements and casting off the needle loops formed by the intermediate needles in the second double yarn course. The alternate dial elements are then moved radially outwardly to advance the cutting edges thereof against the first and second pile loops formed thereover and retained thereon, thereby cutting the first and second pile loops to form cut pile ends. In each succeeding cycle, the third and fourth pile loops are retained over the intermediate dial elements until the knitting of the first and second double yarn courses is completed, thereby casting off the needle loops formed in the third and fourth double yarn courses, at which time the intermediate dial elements are moved radially outwardly to advance the cutting edges thereof against the third and fourth pile loops formed thereover and retained thereon.

In accordance with the present invention, a new and novel velour-like cut-pile fabric may be knit by employing the third specific embodiment outlined above. The resulting fabric has the yarn in alternate courses formed in loops which appear in alternate wales and float stitches which float across intermediate wales. The loops of the alternate courses extend walewise beneath the float stitches of an adjacent intermediate course and are knit with the corresponding loops of an adjacent alternate course, and the float stitches of the alternate courses extend coursewise across the walewise loops of an other adjacent intermediate course. Extending coursewise between the courses of each adjacent pair of alternate courses is an intermediate course of yarn in which loops are formed in intermediate wales and float stitches float across alternate wales. The loops of each intermediate course extend walewise beneath the floating stitches of an adjacent alternate course and are knit with the corresponding loops of an adjacent intermediate course, and the float stitches of each intermediate course extend coursewise across the walewise loops of an other adjacent alternate course. In this manner, the alternate and intermediate courses, although not actually knit together in the traditional sense, are interlocked into one fabric. A pile loop forming yarn is knit in plating relationship to each coursewise yarn described above and therefore cut pile ends project from the fabric face from each walewise side of each walewise loop in alternate and intermediate course.

According to another feature of the invention utilized in the second and third above-described embodiments, guiding means is provided to engage the pile loops retained on the yarn supporting surfaces of the dial elements at a location beneath the dial elements and radially inwardly of the cylinder needles, and to guide the cut pile ends of the pile loops progressively radially inwardly of the cylinder after the cutting thereof and out of possible entanglement with the loops subsequently being knit.

In a fourth embodiment of the present invention, the pile yarn is associated with the body yarn stitches by inlaying the pile yarn in the body yarn stitches in a non-knitted condition. According to the fourth embodiment, a first body yarn is fed to and knitted by the cylinder needles to form first stitches of the first body yarn on the needles. Subsequently, both a second body yarn and a pile yarn are fed to the needles, the second body yarn being fed in the manner of the first body yarn and the pile yarn being fed at another location for receipt thereby by the needles for non-knitting manipulation and being also fed to the yarn supporting surfaces of the dial elements for pile loop formation. The needles and dial elements are manipulated respectively transversely to form second stitches of the second body yarn, to inlay the pile yarn in the first body yarn stitches in non-knitted condition and form pile loops of the pile yarn on the dial elements, and to cast off the needles the first body yarn stitches and the inlaid pile yarn to anchor the inlaid pile yarn in the first body yarn stitches while distending and retaining the pile loops on the dial elements with the hooks thereof. Subsequent to the casting off of the first body yarn stitches and the inlaid pile yarn, the dial elements are further manipulated transversely of the needles to cause the cutting edges thereof to sever the retained pile loops thereby to form cut-pile ends.

BRIEF DESCRIPTION OF THE DRAWINGS

FIGS. 2–9 are enlarged perspective views of sequential sections of the cylinder and dial of a circular knitting machine equipped to practice one embodiment of the present invention, the views illustrating the progressive action of the knitting elements in carrying out the first preferred embodiment;

FIGS. 10–19 are enlarged perspective views of sequential sections of the cylinder and dial of a circular knitting machine equipped to practice a second embodiment of the present invention, the views illustrating the progressive action of the knitting elements in carrying out the second preferred embodiment;

DESCRIPTION OF THE PREFERRED EMBODIMENT

Figure 1:
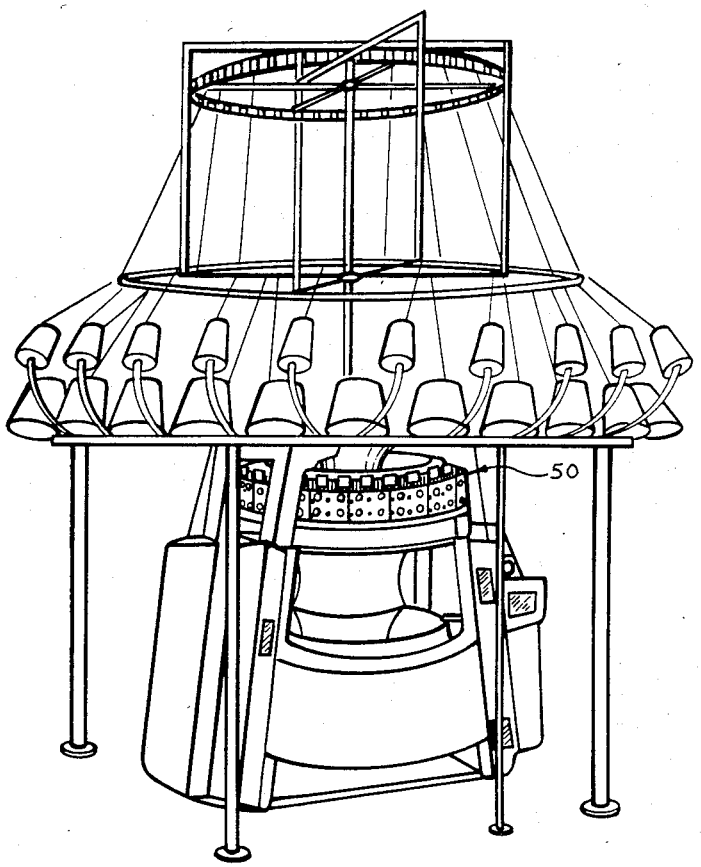
PRIOR ART Fig. 1
FIG. 1 is a perspective view of a conventional prior art circular knitting machine having a dial and a cylinder.
Figure 14:
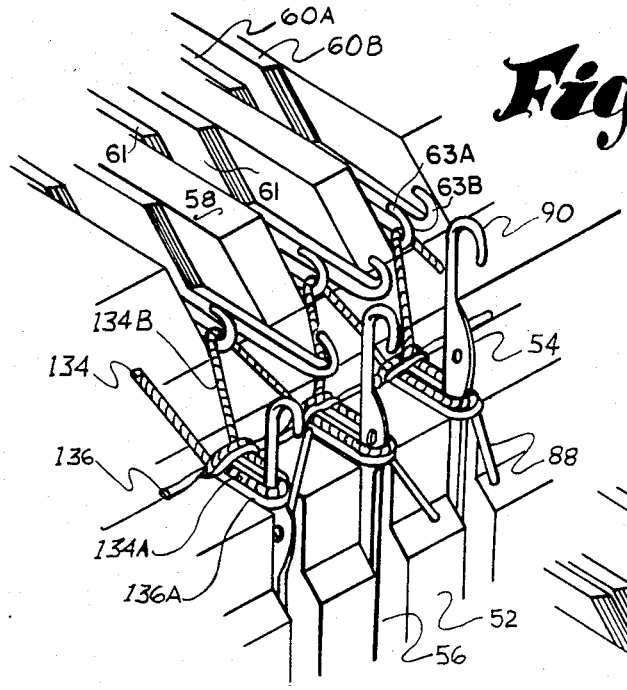
Figure 15:
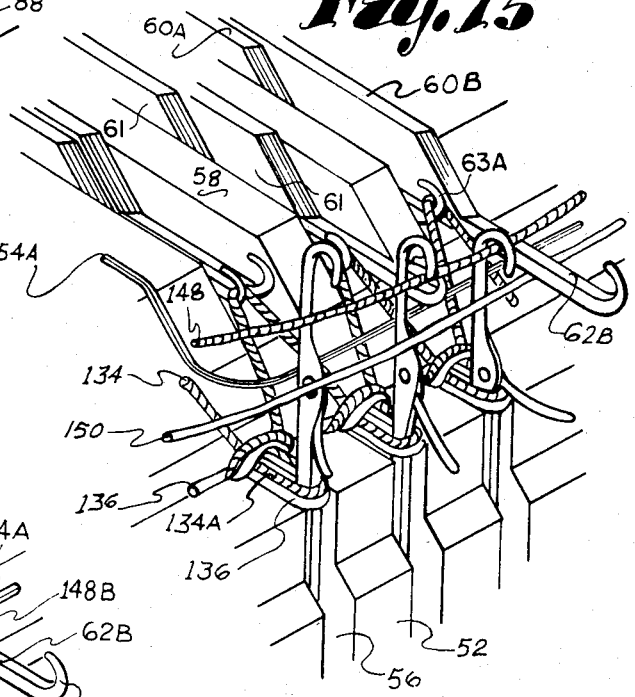
Figure 16:
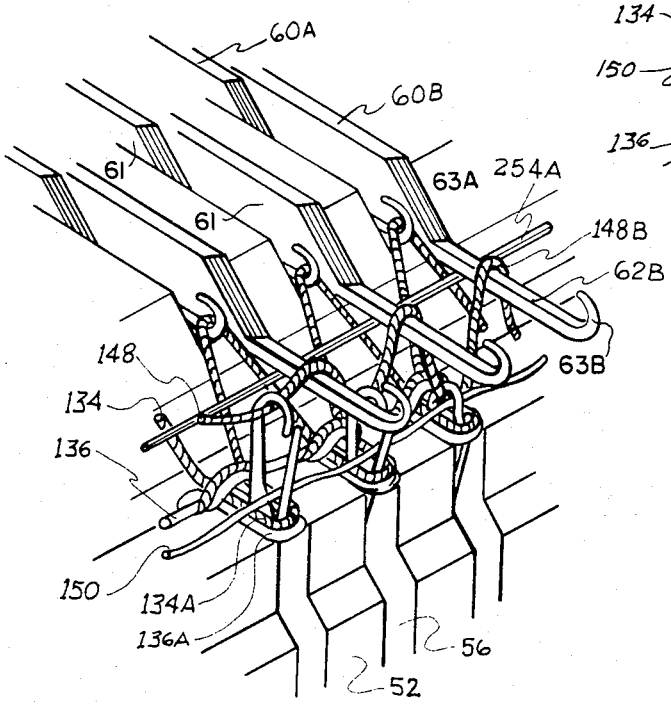

The present invention as illustrated in the accompanying drawings provides a new and novel method and apparatus for producing knitted cut-pile or velour fabric on a conventional circular knitting machine having a cylinder and a dial, an example of which is illustrated in FIG. 1. Conventionally, such machines are provided with latch needles in each dial and cylinder slot, the knitting action being performed by rotating the dial and cylinder in synchronism, the dial and cylinder needles being acted upon for lengthwise movement respectively transversely by stationary needle cams located adjacent said dial and cylinder, the location of these knitting elements being generally indicated at 50.

The present invention, as can be seen in each of FIGS. 2–25 and 44–48 also utilizes a rotatable needle cylinder 52 having a plurality of conventional latch needles 54 located in cylinder slots 56 of the cylinder 52 and a rotatable dial 58 which rotates in synchronism with the cylinder 52. However, in practicing the present invention, the latch needles conventionally located in each dial slot 66 have been replaced by a plurality of dial elements 60 each having a lengthwise extending body member 61 having formed on one longitudinally extending surface thereof an open sided hook 63 at one end thereof, a shoulder sharpened to provide yarn cutting edge 64 spaced from and facing the open side of the hook 63, and a yarn supporting surface 62 extending therebetween. The dial cutting elements 60 are disposed within dial slots 66 for movement by conventional dial needle camming means radially inwardly and outwardly of the dial 58 between the cylinder needles 54, the dial elements 60 being movable radially outwardly to a first position (see, e.g. FIGS. 3 and 4) for receiving a pile yarn thereover such that pile loops may be formed thereon and movable radially inwardly to a second position (e.g. FIGS. 5 and 6) in which the pile loops are drawn away from the needles and movable radially outwardly to a third position (e.g. FIG. 9) in which the pile loops may be cut against the sharpened cutting edges 64 to form cut pile or velour ends. Four specific embodiments of this concept are presently contemplated, each being more fully described herein, however it is to be understood that the present invention is applicable as well to other embodiments and is intended to be limited only by the claims appended hereto.

Figure 26:
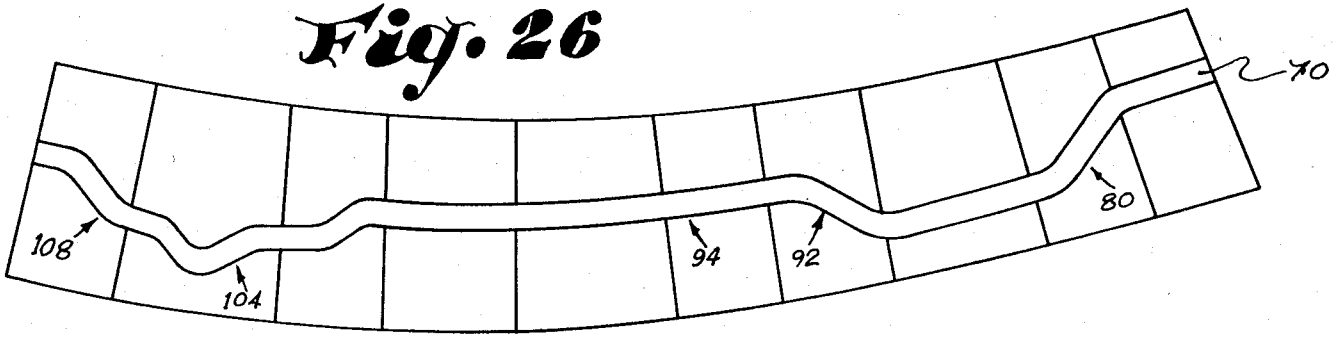
FIG. 26 is a view looking upwardly from within the needle cylinder of a circular knitting machine of one full section of the dial cams which control the action of the dial elements in practicing the first embodiment of the present invention.
Figure 27:
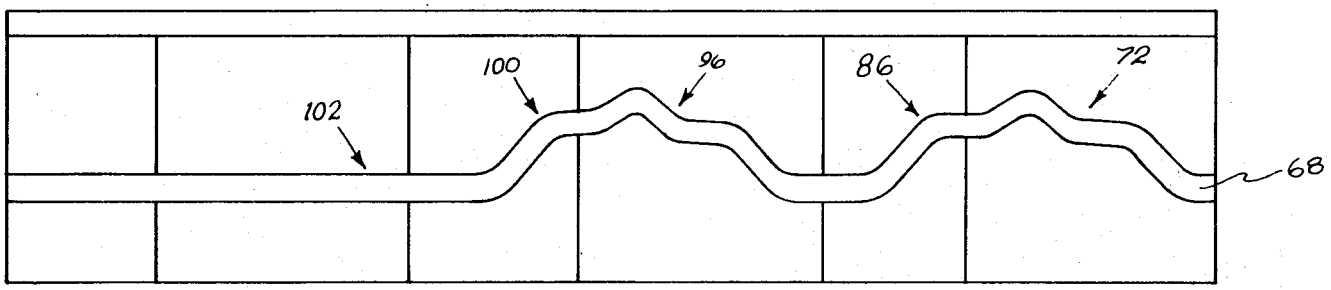
FIG. 27 is a view looking outwardly from the axis of the needle cylinder of a circular knitting machine of one full section of the needle cams which control the action of the cylinder needles in practicing the first embodiment of the present invention.

Referring first to FIGS. 2–9, a sequence of views is shown progressively illustrating the respective action of the dial cutting elements 60 and the cylinder needles 54 during one complete knitting cycle in carrying out the first embodiment of the present invention. FIG. 27 illustrates a section of the cylinder needle cams which controls the action of the cylinder needles 54 during one complete knitting cycle of the first embodiment, while FIG. 26 illustrates a corresponding section of the dial needle cams which controls the action of the dial elements 60 during one complete knitting cycle. Initially, it should be noted that in each of FIGS. 26 and 27, the direction of movement of the dial elements 60 and needles 54 along the stationary cam tracks 70 and 68, respectively, is from right to left. As can be seen in each of FIGS. 2–9, each cylinder slot 56 contains a latch needle 54 of conventional construction and each dial slot 66 contains one dial element 60, a dial element 60 being radially movable between each pair of adjacent cylinder needles 54.

FIG. 2 represents the beginning of the knitting cycle of the first embodiment, the cylinder needles 54 having been raised within the cylinder slots 56 to their yarn receiving position by the portion of the cam track 68 generally indicated by 72, with the needle loops 74 of the previously formed course resting on the upper edge 76 of the cylinder 52 about the stems 78 of the needles 54. Dial elements 60 are being moved radially outwardly to the aforesaid first position by the portion of cam track 70 indicated generally at 80 (FIG. 26). With the needles and dial elements in this disposition, a yarn 82 for forming pile loops is fed by conventional means (not shown) to the cylinder needles 54 at a location above the radially outwardly extending dial elements 60, while a yarn 84 for forming fabric base or body loops is simultaneously fed to the cylinder needles 54 at a location below the dial elements 60. As the needles 54 travel downwardly within slots 56 under the influence of the portion of cam track 68 indicated generally at 86, the needle loops or stitches 74 of the previously formed course bear against the needle latches 88 and close it as yarns 82 and 84 are drawn into the hooks 90 of needles 54 with pile loop forming yarn 82 being drawn over and retained on the yarn supporting surfaces 62 of dial elements 60, as shown in FIG. 3. As the needles 54 complete their downward movement, FIG. 4, needle loops 82A of the pile loop forming yarn and needle loops 84A of the fabric base loop forming yarn are drawn in plating relationship through the needle loops 74 of the previously formed course (as shown in FIG. 4), the needle loops 74 being cast off the needles 54 as the needle hooks 90 are withdrawn downwardly into the slots 56 below the upper edge 76 of the cylinder 52, and simultaneously pile loops 82B are formed over and retained on the yarn supporting surfaces 62 of the dial elements 60.

It should be noted that in practicing each embodiment of the present invention, the pile loop forming yarn is anchored in the base fabric formed by the fabric base loop forming yarn prior to cutting the pile loops against the sharpened yarn cutting edge, this anchoring being obtained in each embodiment by casting the pile loop forming yarn off the cylinder needles. In each of the first three embodiments, the pile yarn is knit in plating relation with the base or body yarn and, accordingly, the casting-off of the pile yarn to anchor it in the base fabric prior to the cutting of the pile loops is achieved by drawing needle loops or stitches of another subsequently fed yarn through the plated needle loops of the pile and body yarns. In the first embodiment, casting off of the plated needle loops 82A and 84A is achieved by knitting a single jersey course of fabric base loop forming yarn subsequent to the knitting of each course in which pile loops 82B are formed over the dial elements 60. Thus, as shown in FIGS. 5 and 6, the dial elements 60 are withdrawn to the aforesaid second position within the dial slots 66 by the portion of cam track 70 generally indicated at 92, with the hooks 63 of the dial elements 60 retaining and distending the pile loops 82B on the dial elements. The dial elements 60 remain withdrawn under influence of the portion of cam track 70 indicated generally at 94, while the needles 54 are raised to their yarn receiving position by the portion of cam track 68 as indicated at 96. As the needles 54 are raised to their yarn receiving position, needle loops 82A and 84A bear against the needle latch 88 and open it, needle loops 82A and 84A thereafter resting upon the edge 76 of the cylinder 52 about the stems 78 of the needles 54 (see FIG. 5). As shown in FIG. 6, a second yarn 98 for forming fabric base loops is then fed to the cylinder needles 54. The needles 54 again travel downwardly under the influence of the portion of cam track 68 generally indicated at 100, the needle loops 82A and 84A of the preceding course bearing against the needle latch 88 and closing it. As the needles 54 complete their downward movement, needle loops 98A of the fabric base loop forming yarn are drawn through the needle loops 82A and 84A of the preceding course, the needle loops 82A and 84A being cast off the needles 54 as the needle hooks 90 are withdrawn into the slots 56 below the upper edge 76 of the cylinder 52, all as shown in FIG. 8. Since the dial elements 60 are withdrawn by the portion of cam track 70 indicated at 94 during the knitting of the second fabric base loop forming yarn 98, no loops are formed over the dial elements 60, and therefore the knitted course formed is single jersey. The cylinder needles 54, having cast-off the needle loops 82A and 84A of the pile loop forming yarn 82 and the fabric base loop forming yarn 84, remain withdrawn below the upper edge 76 of the cylinder 52 under the influence of the portion of cam track 68 indicated generally at 102, while the dial elements 60 are moved outwardly to the aforesaid third position under influence of the portion of cam track 70 indicated generally at 104, thereby advancing the yarn cutting edges 64 of the dial elements 60 against the pile loops 82B formed over and retained on the yarn supporting surfaces 62 thereof and cutting the retained pile loops 82B to form cut pile ends 82C.

Figure 32:
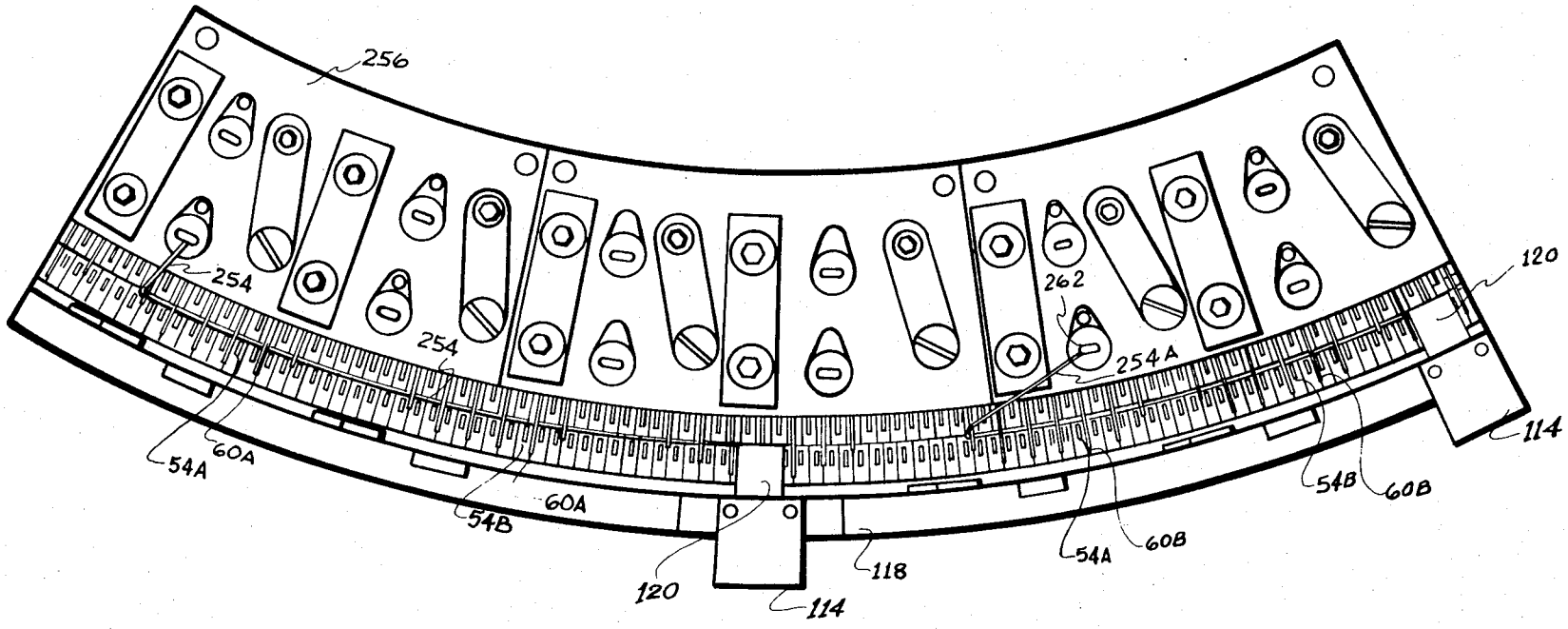
FIG. 32 is a detailed plan view of one full section of the dial and cylinder of a knitting machine equipped to carry out the third embodiment of the present invention.
Figure 33:
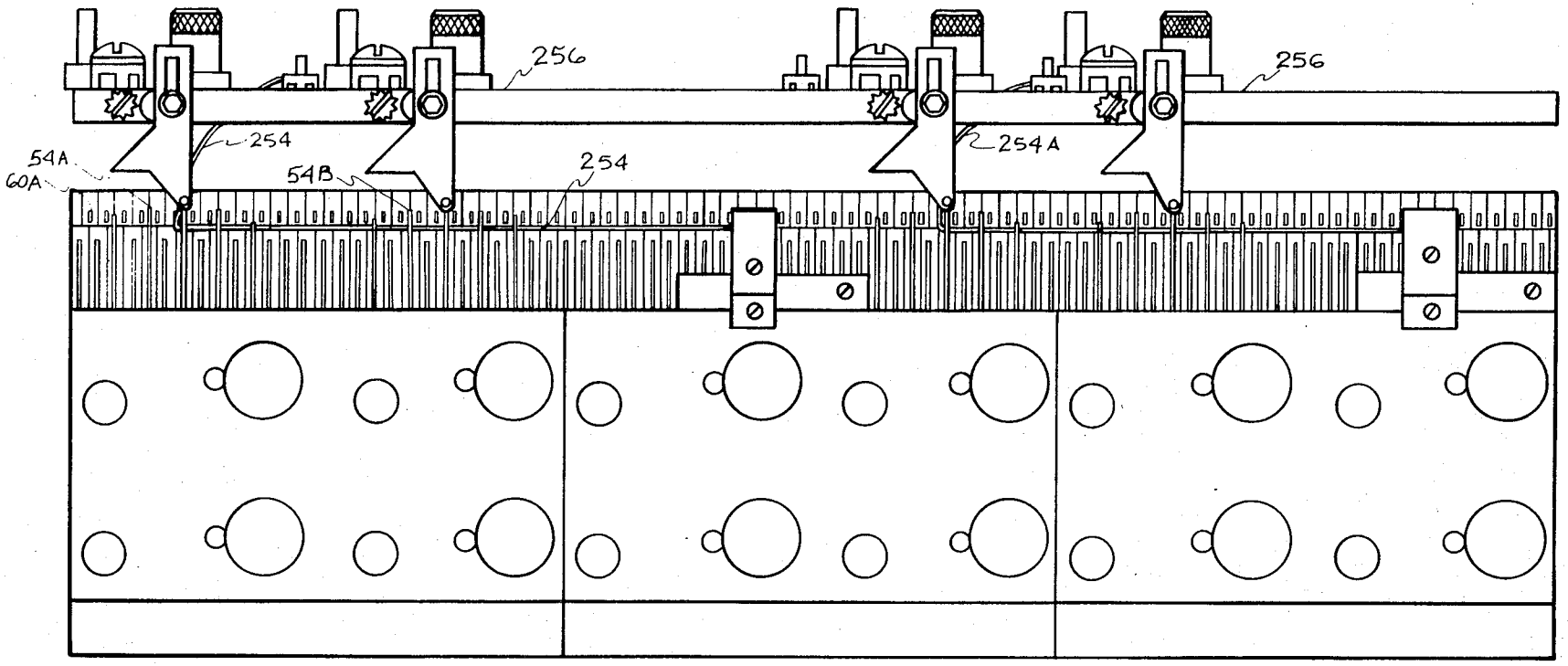
FIG. 33 is a detailed elevational view of the apparatus illustrated in FIG. 32.

To aid the dial elements 60 in the cutting of the pile loops 82B retained on the yarn supporting surfaces 62 thereof, means is provided in each of the three embodiments of the present invention for clamping the pile loops 82B against a curved serrated surface 116 of the dial during the radially outward cutting movement of the dial elements 60. The clamping means is rigidly affixed to the stationary cylinder cam plate 118 radially outwardly of the dial and immediately adjacent the location of cutting of the pile loops 82B, as shown in FIGS. 32 and 33 in conjunction with the third embodiment of the present invention. The clamping means 114 includes a presser bar 120 extending therefrom radially inwardly toward the serrated outer surface 116 of the dial 58 and between the withdrawn needles 54 and the dial elements 60. The pressing surface 122 of the presser bar 120 is arcuately concave so as to conform to the arcuately convex outer circumference 116 of the dial 58. In this manner, as the dial elements 60, carried in the slots 66 of the rotating dial 58, pass the location of cutting and are moved radially outwardly by the portion of the cam track indicated at 104, the stationary presser bar 120 presses the pile loops 82B carried on the yarn supporting surfaces 62 of the dial elements 60 against the serrated outer surface 116 of the dial 58 at a location below the dial elements 60 and above the upper edge 76 of the needle cylinder 52, preventing radially outward movement of the pile loops 82B relative to the cylinder 52 and needles 54 and maintaining the retained pile loops 82B in effective position for cutting by the dial element cutting edges 64. It should be noted that the serrated nature of dial surface 116 is illustrated only in FIG. 9 with respect to the first embodiment of the present invention and not in any other of FIGS. 2–25 and 44–48, it being understood that the entire circumferential dial surface 116 in each of the four embodiments is serrated. Thus, the radially outward cutting movement of the dial elements 60 does not pull on the retained pile loops 82B during the cutting thereof and does not cause stretching of the pile loops 82B and distortion of the needle loops 82A. Since the pile loops 82B are effectively held in position during the cutting thereof, the cutting is quicker and cleaner than without clamping means 114 and therefore the dulling effect on the cutting edges 64 is lessened and the useful life of dial elements 60 is prolonged. An additional result is that the cutting of the retained pile loops 82B may be performed effectively even after the sharpened edges 64 of the dial elements 60 have been dulled somewhat by use.

Figure 38:
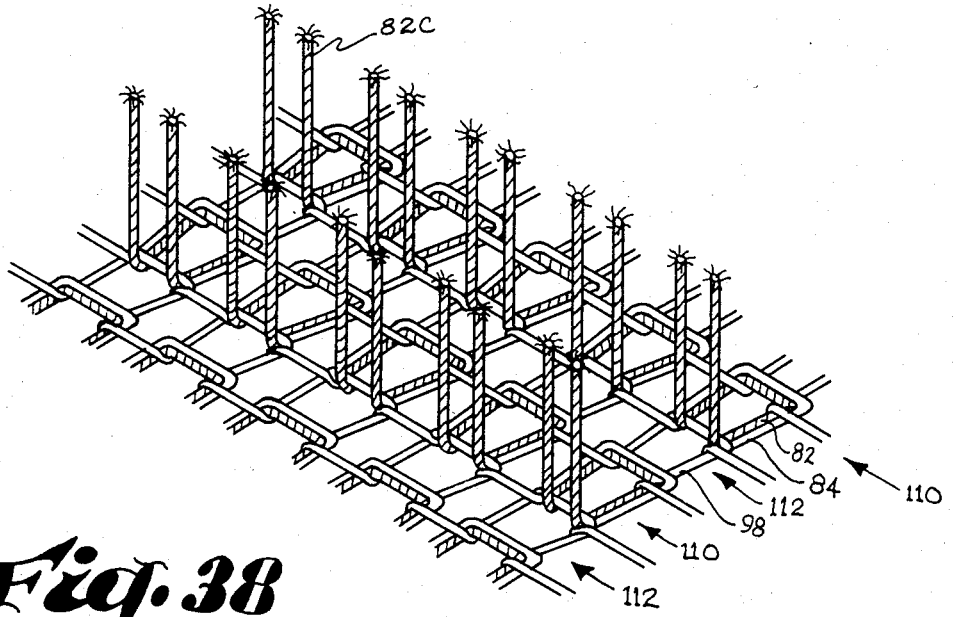
FIG. 38 is a perspective view of the cut-pile fabric produced by practicing the first embodiment of the present invention.
Figure 43:
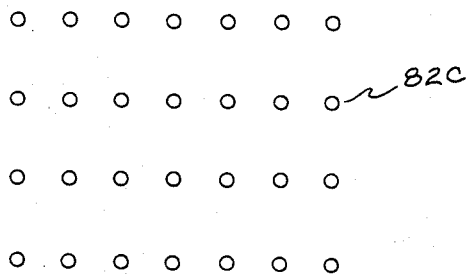
FIG. 43 is a diagrammatic view of the surface pattern of the cut pile ends of the fabric produced by employing the first embodiment of the present invention.

After cutting the retained pile loops 82B, the dial elements 60 withdraw under the influence of the portion of cam track 70 generally indicated at 108, FIG. 26, and the knitting cycle is continuously repeated to form a cut pile fabric. The fabric produced in practicing the above-described first embodiment is illustrated in FIG. 38, and comprises plated two-yarn courses 110, consisting of a pile loop forming yarn 82 and a fabric base loop forming yarn 84 appearing in plating relationship, alternating with single jersey courses 112 of fabric base loop forming yarn 98. The surface effect produced by the cut pile ends 82C of this fabric is illustrated in FIG. 43.

Figure 28:
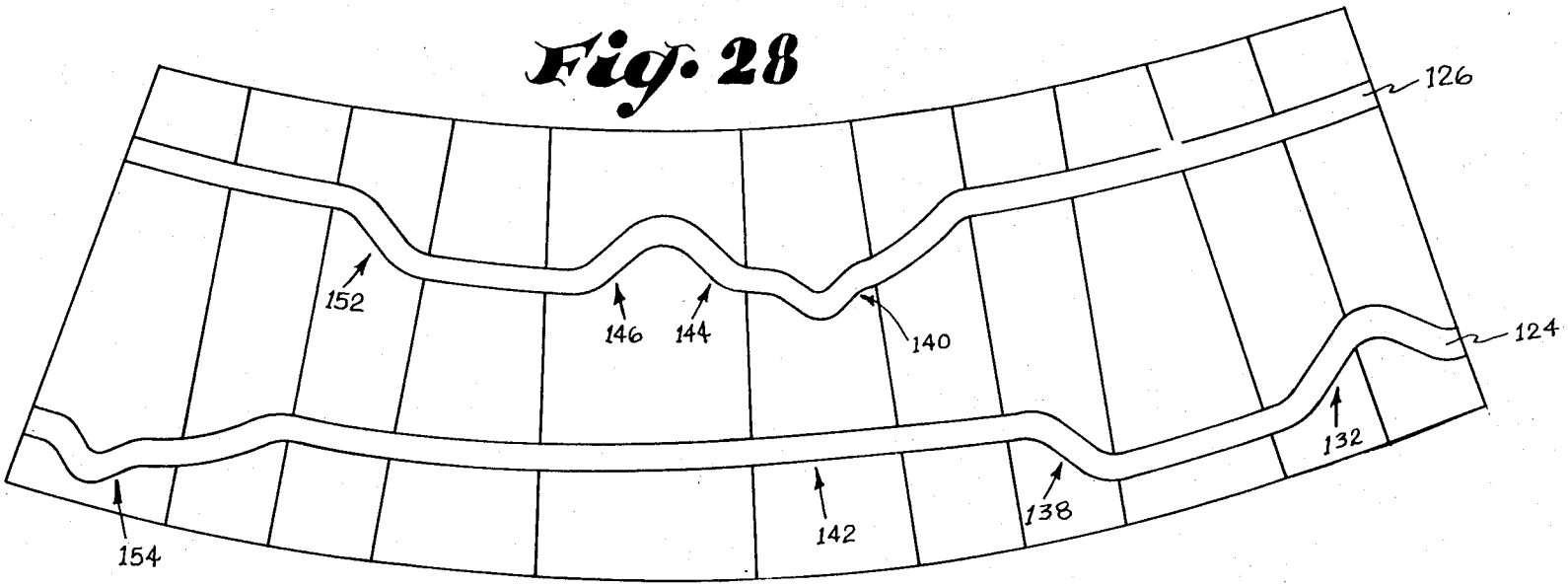
FIG. 28 is a view looking upwardly from within the cylinder of a circular knitting machine of one full section of the dial cams which control the action of the dial elements in practicing the second embodiment of the present invention.
Figure 29:
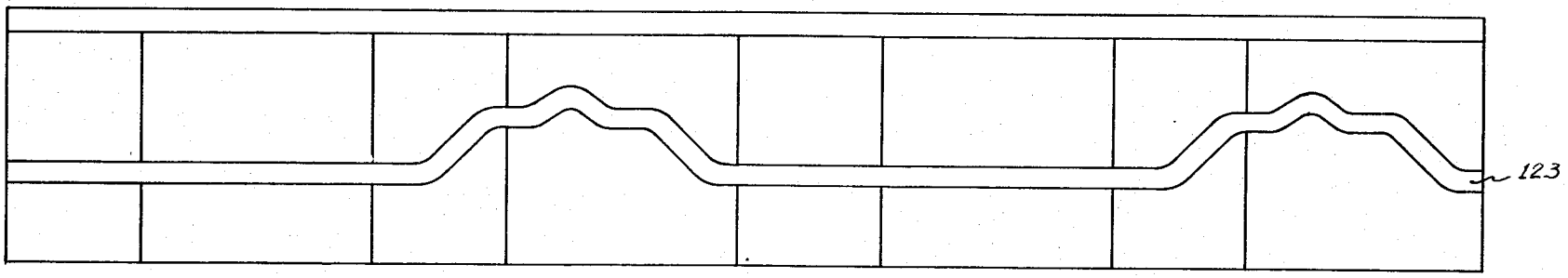
FIG. 29 is a view looking outwardly from the axis of the needle cylinder of a circular knitting machine of one full section of the needle cams which control the action of the cylinder needles in practicing the second embodiment of the present invention.

As noted earlier, conventional velour is produced by using a single jersey stitch pattern and by knitting a pile loop forming yarn in plating relationship with each single jersey course. It is therefore apparent that the fabric produced by employing the above-described first embodiment is not conventional velour fabric. Under the second embodiment of the present invention, it is possible to produce a conventional velour fabric. Referring now to FIGS. 10–19, a sequence of views is shown, progressively illustrating the action of the cylinder needles and dial elements during one full knitting cycle in practicing the second embodiment of the present invention. As can be see in each of FIGS. 10–19, in practicing the second embodiment, the slots 56 of the needle cylinder 52 are provided with a plurality of conventional latch needles 54. However, each slot 66 of the dial 58 is provided with a pair of dial elements 60A and 60B, dial elements 60A being short (in relation to the distance between the hook and the control butt) dial elements, and therefore traveling in cam track 124, FIG. 28, and dial elements 60B being long (in relation to the distance between the hook and the control butt) dial elements and therefore traveling in cam track 126, FIG. 28. A pair of dial elements 60A and 60B is thus radially movable by conventional camming means between each pair of adjacent cylinder needles 54. The corresponding section of the cylinder needle cams which control the action of the needles in practicing the second embodiment is illustrated in FIG. 29, while a section of the dial cams which control the action of the dial elements during one knitting cycle in practicing the second embodiment is shown in FIG. 28. In FIG. 29, cam track 123 controls the action of the cylinder needles 54. In FIG. 28, the cam track 124 controls the action of the short dial elements 60A while cam track 126 controls the action of the long dial elements 60B. Again, it should be noted that the direction of movement of the needles and dial elements along the cam tracks of FIGS. 29 and 28, respectively, is from right to left.

Figure 17:
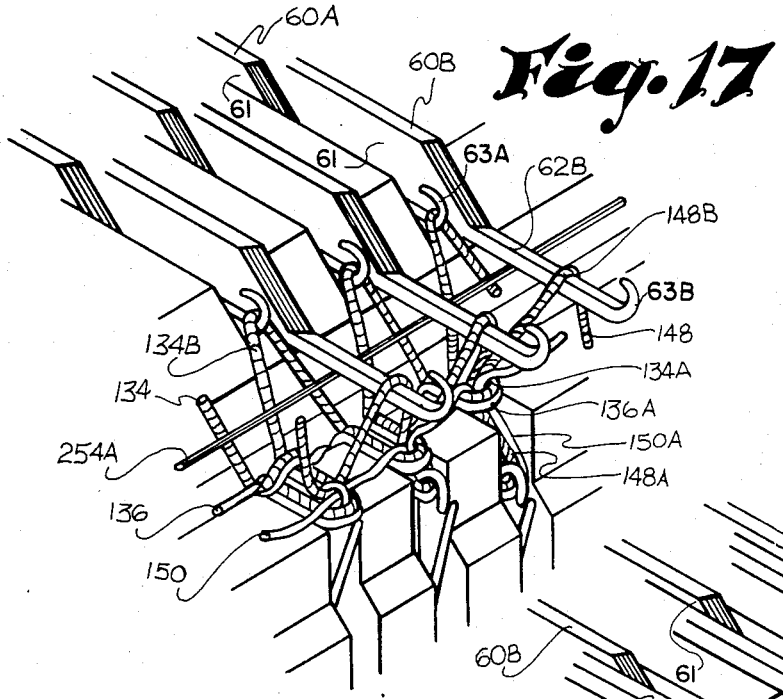
Figure 18:
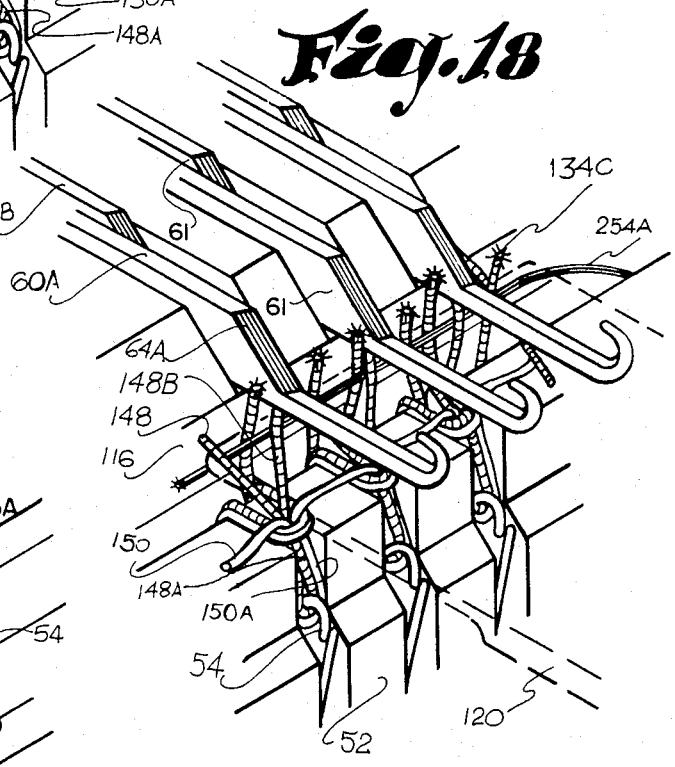
Figure 19:
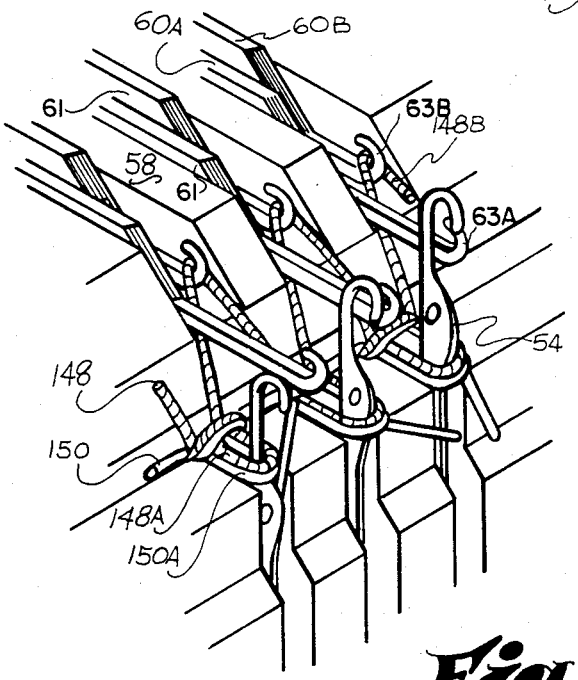

FIG. 10 illustrates the beginning of the knitting cycle of the second embodiment. Needles 54 have been raised to their yarn receiving position after having knitted the previous course. Needle loops or stitches 128A and 130A of pile loop forming yarn 128 and fabric base loop forming yarn 130, respectively, formed during the knitting of the previous course, have forced open the latches 88 of the needles 54 during the needles' rise and now rest on the upper edge 76 of the cylinder 52 about the stems 78 of the needles 54. Pile loops 128B formed over dial elements 60B during the knitting of the preceding course are retained on the yarn supporting surfaces 62B of dial elements 60B which have been retracted within the dial 58 to the second position. Dial elements 60A are being moved radially outwardly to the first position between the cylinder needles 54 by the portion of cam track 124 indicated generally at 132. With the needles 54 and dial elements 60A and 60B in this disposition, a yarn 134 for forming pile loops is fed to the needles 54 at a location above the yarn receiving surface 62A of the dial elements 60A while a yarn 136 for forming fabric base loops is fed to the needles at a location below the dial elements 60A. In conventional manner, the cylinder needles 54 are moved downwardly within the cylinder slots 56, FIG. 11, drawing needle loops 134A and needle loops 136A of pile loop forming yarn 134 and fabric base loop forming yarn 136, respectively, in plating relationship through needle loops 128A and 130A formed during the knitting of the preceding course (as shown in FIG. 12), thereby casting off needle loops 128A and 130A, while forming pile loops 134B of pile loop forming yarns 134 over the dial elements 60A, FIG. 12. The casting off of the needle loops 128A and 130A of the preceding course having been completed, the needles 54 remain withdrawn into the cylinder slots 56 while dial elements 60A are withdrawn into the dial by that portion of cam track 124 indicated at 138, retaining and distending the pile loops 134B on the hooks 63A on the ends of the dial elements 60A. The dial elements 60B are then moved radially outwardly to the third position under the influence of the portion of cam track 126 indicated generally at 140 to advance the cutting edges 64B thereof against the pile loops 128B formed over and retained thereon, thereby cutting the pile loops 128B to form cut pile ends 128C, FIG. 13. As described above with respect to the first embodiment, presser bar 120 clamps the pile loops 128B against the serrated dial surface 116 during the cutting thereof. While dial elements 60A remain withdrawn within the dial 58 with pile loops 134B retained thereon under influence of the portion of cam track 124 indicated at 142, dial elements 60B are withdrawn momentarily within the dial 58 by the portion of cam track 126 indicated at 144 and are then moved radially outwardly under the influence of the portion of cam track 126 indicated at 146. The cylinder needles 54 are again raised to their yarn receiving position, the needle loops 134A and 136A within the hooks 90 of the needles 54 forcing open the latches 88 thereof, FIG. 14. With dial elements 60B extending radially outwardly between cylinder needles 54, a second yarn 148 for forming pile loops is fed to the needles 54 at a location above the dial elements 60B while a second yarn 150 for forming fabric base loops is fed to the needles at a location below the dial elements 60B. In conventional manner, the needles 54 are again moved downwardly within cylinder slots 56 drawing needle loops 148A of pile loop forming yarn 148 and needle loops 150A of fabric base loop forming yarn 150 in plating relationship through needle loops 134A and 136A of the preceding course (as shown in FIG. 17), thereby casting off needle loops 134A and 136A while simultaneously forming second pile loops 148B of pile loop forming yarn 148 over dial elements 60B, FIGS. 16 and 17. The casting off of the needle loops 134A and 136A having been completed, dial elements 60B are withdrawn into the dial 58 by the portion of cam track 126 indicated at 152 while retaining the pile loops 148B on the hooks 63B of the dial elements 60B. The needles 54 remain withdrawn, and the dial elements 60A are moved radially outwardly under the influence of the portion of cam track 124 indicated generally at 154 to advance the cutting edges 64A thereof against the pile loops 134B formed over and retained thereon, thereby cutting the pile loops 134B to form cut pile ends 134C, FIG. 18. A presser bar 120 again clamps the pile loops 134B against the dial 58 during the cutting thereof to aid in the cutting. As illustrated in FIG. 19, dial elements 60A, after performing the cutting operation just described again withdraw into the dial 58 while the needles 54 again rise to their yarn receiving position thereby preparing to repeat the described cycle of the second embodiment.

Figure 35:
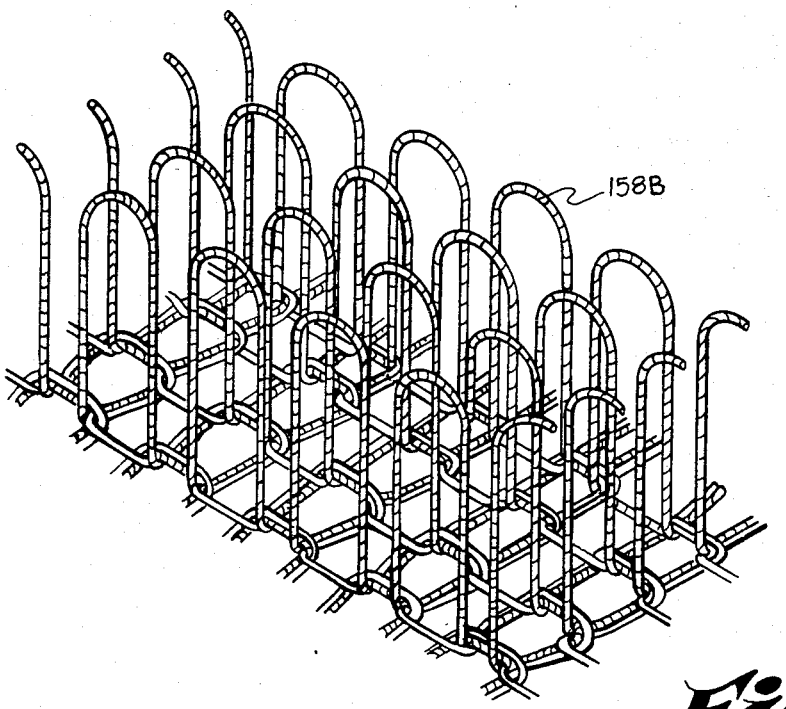
PRIOR ART Fig. 35
FIGS. 35 and 36 are perspective views of conventional prior art velour fabric prior to shearing of the pile loops.
Figure 36:
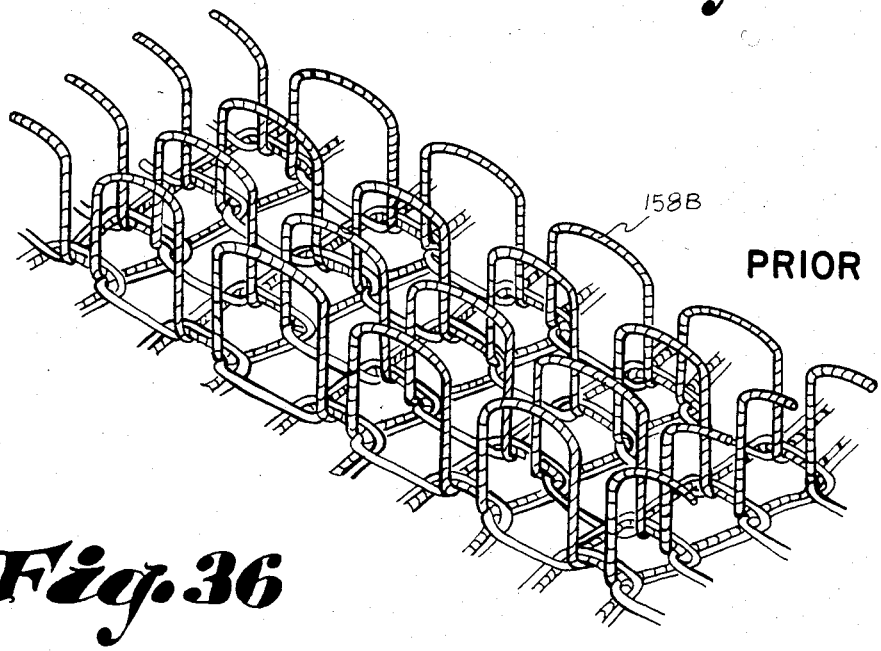
PRIOR ART Fig. 36
Figure 37:
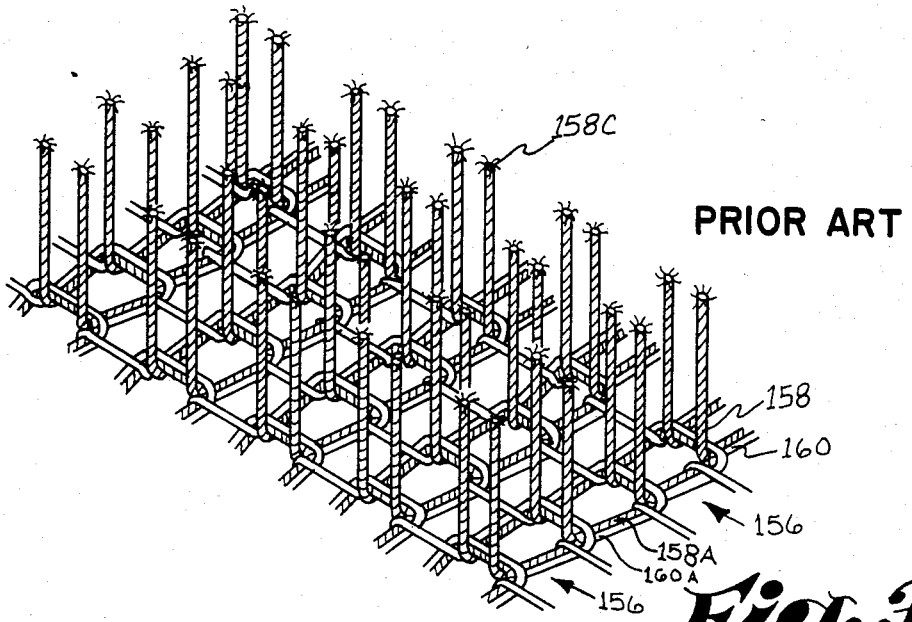
FIG. 37 is a perspective view of conventional prior art velour fabric.
Figure 41:
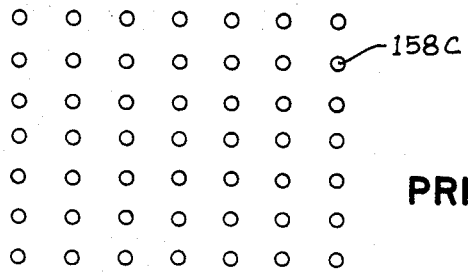
PRIOR ART Fig. 41
FIG. 41 is a diagrammatic view of the surface pattern of the cut pile ends of conventional prior art velour fabric.

The conventional velour fabric knitting by employing the above-described second embodiment is illustrated in FIG. 37. This fabric, as does conventionally knitted velour fabric after shearing, comprises a plurality of plated two-yarn courses 156 including a pile loop forming yarn 158 and a fabric base loop forming yarn 160 knit in plating relationship in a single jersey stitch pattern, each couse having a plurality of needle loops 158A of pile loop forming yarn 158, a plurality of needle loops 160A of fabric base loop forming yarn 160, and a plurality of cut pile ends 158C extending from each walewise side of each needle loop 158A. In comparison, FIGS. 35 and 36 illustrate conventionally knitted velour fabric prior to shearing. FIG. 35 illustrates the approximate required minimum height of pile loops 158B which would be necessary in conventional velour knitting to produce a velour fabric having cut pile ends of a height comparable to that of FIG. 37 after shearing of the pile loops. In contrast, FIG. 36 illustrates the approximate height of pile loops 158B which would be achieved in employing the present invention without cutting the pile loops 158B. The surface effect produced by the cut pile ends 158C of the conventional velour fabric of FIG. 37 is illustrated in FIG. 41.

Figure 30:
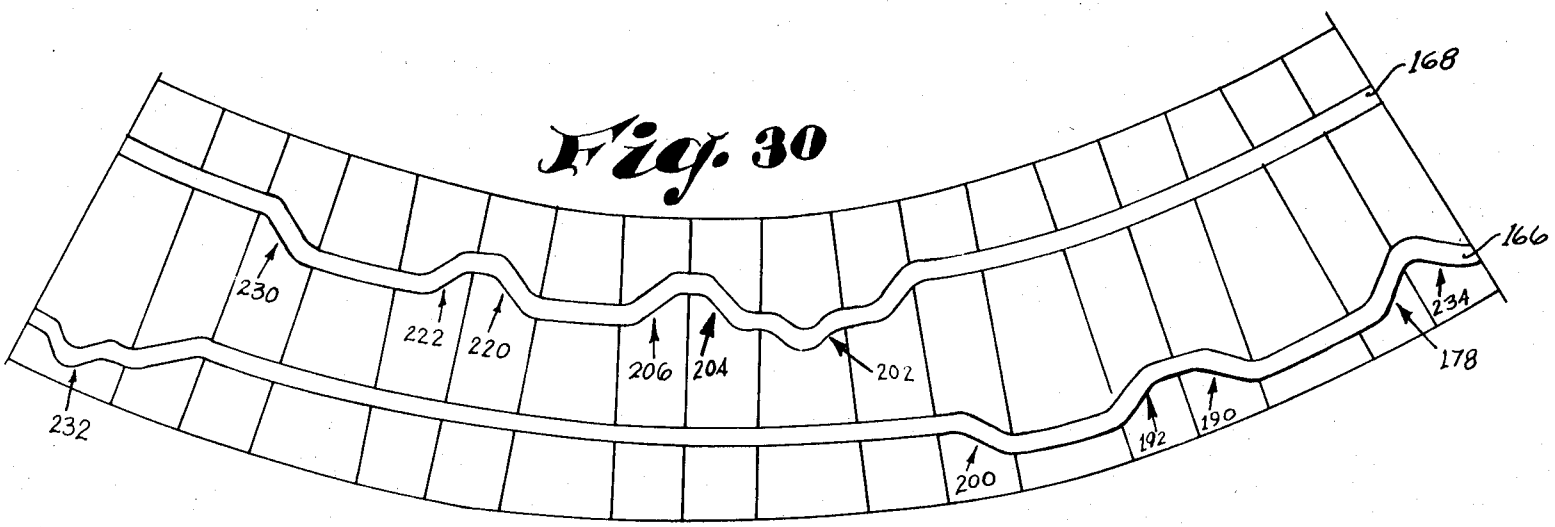
FIG. 30 is a view looking upwardly from within the needle cylinder of a circular knitting machine of one full section of the dial cams which control the action of the dial elements in practicing the third embodiment of the present invention.
Figure 31:
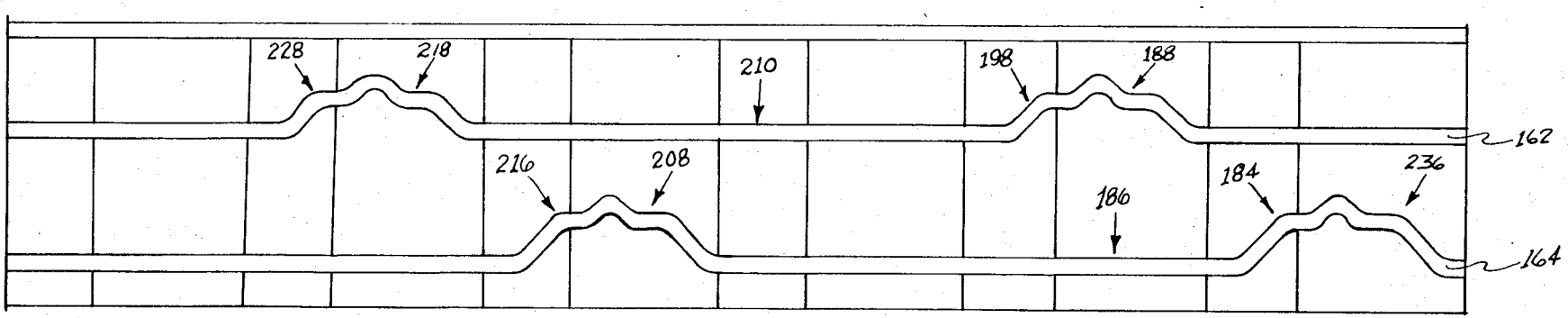
FIG. 31 is a view looking outwardly from the axis of the needle cylinder of a circular knitting machine of one full section of the needle cams which control the action of the cylinder needles in practicing the third embodiment of the present invention.

Referring now to FIGS. 20–25, a sequence of views is shown, progressively illustrating the action of the cylinder needles and dial elements during one full knitting cycle in practicing the third embodiment of the present invention. As can be seen in each of FIGS. 20–25 a single cylinder needle and a single dial element are provided in each cylinder slot 56 and dial slot 66. However, in contrast to the first and second embodiments, cylinder slots 56 are provided with both long (in relation to the distance between the hook and the control butt) cylinder needles 54A and short (in relation to the distance between the hook and the control butt) cylinder needles 54B, each alternate cylinder slot 56A being provided with a long cylinder needle 54A and each intermediate cylinder slot 56B being provided with a short cylinder needle 54B. Thus, the needles are arranged with alternate long needles and intermediate short needles. In similar manner, dial slots 66 are provided with both short dial elements 60A and long dial elements 60B, each alternate dial slot 66A provided with a short dial element 60A and each intermediate dial slot 66B being provided with a long dial element 60B. Thus, the dial elements are arranged with alternate short dial elements and intermediate long dial elements. As in the first embodiment, a dial element is radially movable between the needles of each pair of adjacent cylinder needles. A section of the cylinder needle cam which controls the action of the needles 54A and 54B in practicing the third embodiment of the present invention is illustrated in FIG. 31, while a corresponding section of the dial cam which controls the action of the dial elements 60A and 60B in the third embodiment is illustrated in FIG. 30. Again it should be noted that the direction of movement of the needles and dial elements along the cam tracks of FIGS. 31 and 30, respectively, is from right to left. In FIG. 31, cam track 162 controls the action of the short cylinder needles 54B, with cam track 164 controlling the action of the long cylinder needles 54A. In FIG. 30, cam track 166 controls the action of the short dial elements 60A, with cam track 168 controlling the action of the long dial elements 60B.

Figure 20:
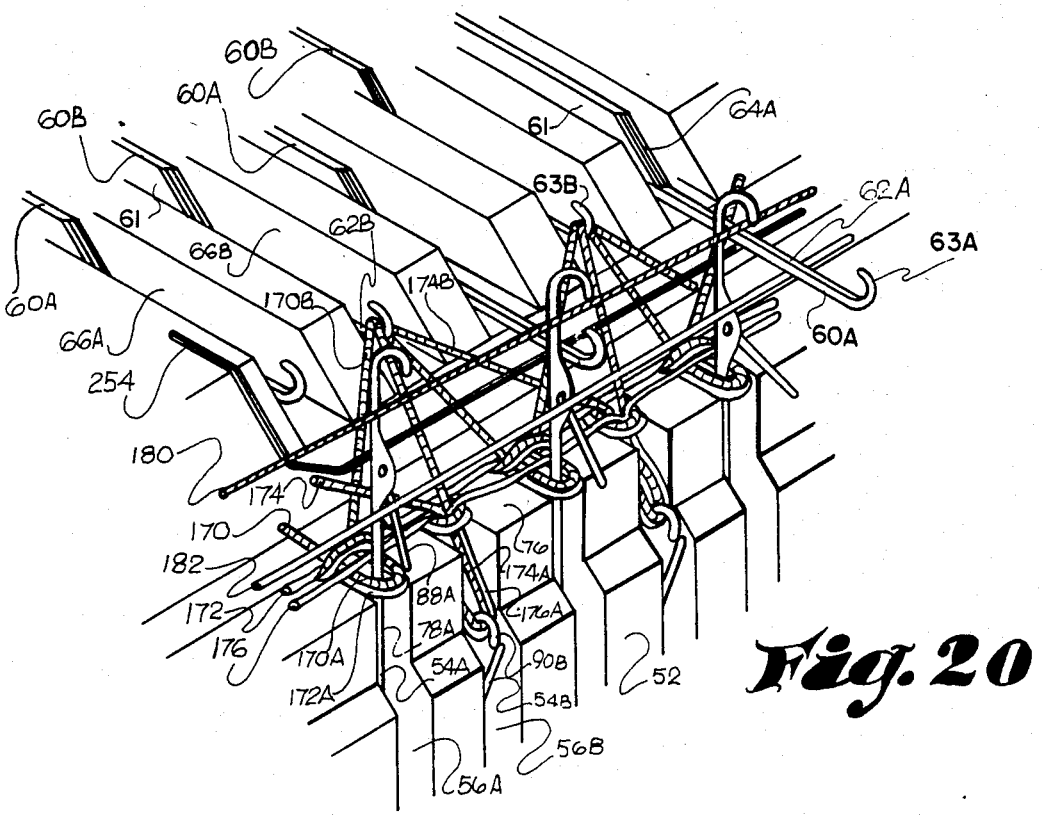
FIGS. 20–25 are enlarged perspective views of sequential sections of the cylinder and dial of a circular knitting machine equipped to practice a third embodiment of the present invention, the views illustrating the progressive action of the knitting elements in carrying out the third preferred embodiment.

FIG. 20 illustrates the beginning of the knitting cycle of the third embodiment. Alternate or long cylinder needles 54A have been raised in alternate cylinder slots 56A to their yarn receiving position, needle loops 170A and 172A of pile loop forming yarn 170 and fabric base loop forming yarn 172, respectively, resting on the upper edge 76 of the cylinder 52 about the stems 78A of the needles 54A, having forced open the latches 88A of the needles 54A. Pile loops 170B of pile loop forming yarn 170, formed over intermediate or long dial elements 60B in the first position, are retained on and distended by the hooks 63B of dial elements 60B, which have been withdrawn within dial slots 66B to the second position. Intermediate or short needles 54B have been moved downwardly within cylinder slots 56B, with needle loops 174A and 176A of pile loop forming yarn 174 and fabric base loop forming yarn 176, respectively, held within the hooks 90B of needles 54B, and with pile loops 174B of pile loop forming yarn 174 retained on the yarn suporting surfaces of withdrawn long dial elements 60B. Alternate of short dial elements 60A are being moved to the first position radially outwardly between raised long cylinder needles 54A by the portion of cam track 166 indicated generally at 178. With the needles 54A and 54B and the dial elements 60A and 60B in this disposition, a yarn 180 for forming pile loops is fed to long needles 54A at a location above dial elements 60A while a yarn 182 for forming fabric base loops is fed to the needles at a location below the short dial elements 60A.

Figure 21:
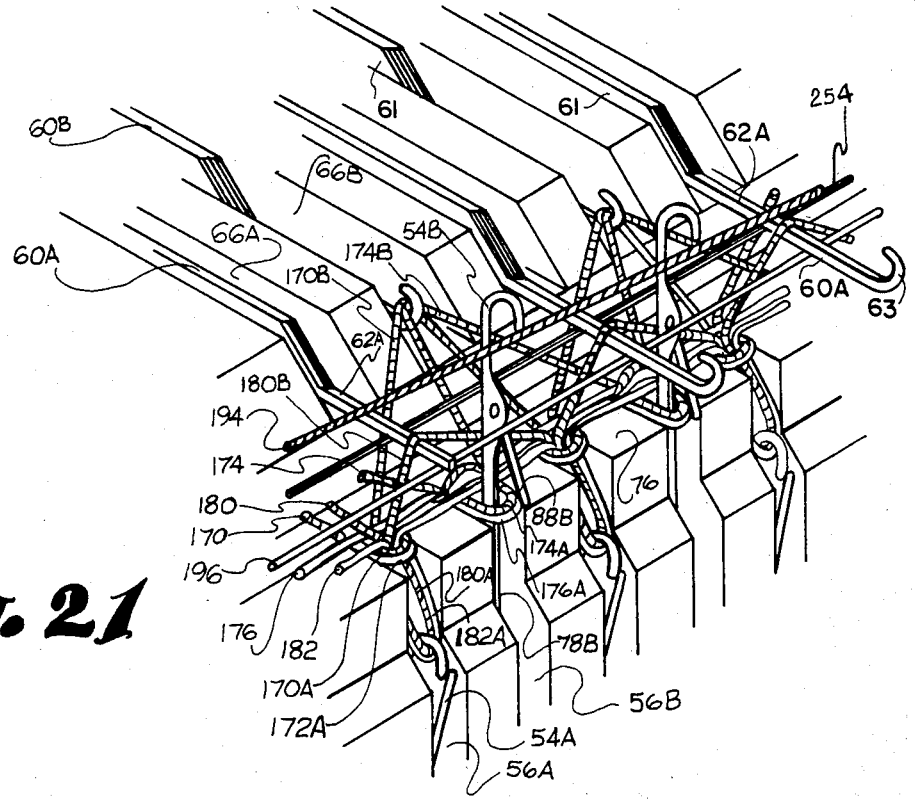
Figure 22:
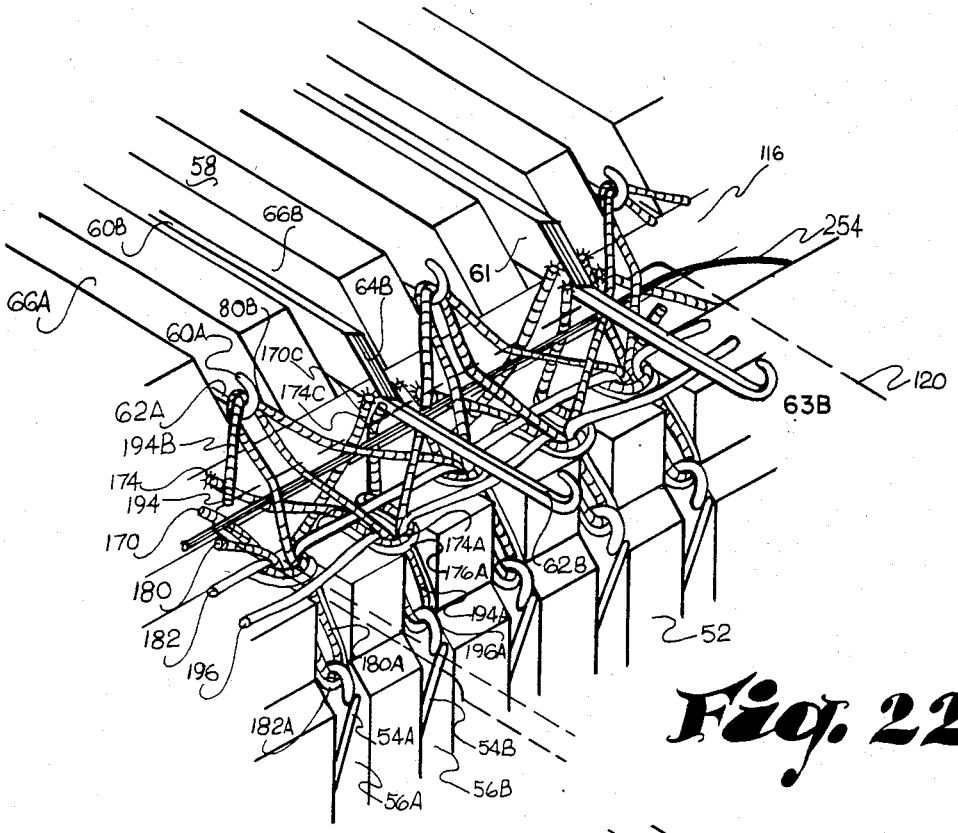

In conventional manner, long needles 54A are moved downwardly within alternate cylinder slots 56A by the portion of cam track 164 indicated at 184 drawing needle loops 180A and 182A of pile loop forming yarn 180 and fabric base loop forming yarn 182, respectively, in plating relationship through needle loops 170A and 172A (as shown in FIG. 21), thereby casting off needle loops 170A and 172A, while forming pile loops 180B of pile loop forming yarn 180 over short dial elements 60A. Long needles 54A remain withdrawn in cylinder slots 56A under the influence of the portion of cam track 164 indicated generally at 186, while short needles 54B are raised to their yarn receiving position by the portion of cam track 162 indicated generally at 188, needle loops 174A and 176A bearing against latches 88B during the rise of needles 54B thereby opening latches 88B and coming to rest on the upper edge 76 of cylinder 52 about stems 78B of needles 54B as needles 54B complete their rise. While retaining the pile loops 180B on the dial element hooks 63A, short dial elements 60A withdraw to the second position within dial slots 66A momentarily during the rise of short needles 54B under the influence of the portion of cam track 166 indicated generally at 190 but are immediately moved radially outwardly to the first position by the portion of cam track 166 indicated at 192. As seen in FIG. 21, a second pile loop forming yarn 194 is fed to short needles 54B at a location above short dial elements 60A while a second fabric base loop forming yarn 196 is fed to short needles 54B at a location below short dial elements 60A. Needles 54B are now moved downwardly within intermediate cylinder slots 56B by the portion of cam track 162 indicated at 198, drawing needle loops 194A and 196A of pile loop forming yarn 194 and fabric base loop forming yarn 196, respectively, in plating relationship through needle loops 174A and 176A (as shown in FIG. 22), thereby casting off needle loops 174A and 176A, while forming second pile loops 194B of pile loop forming yarn 194 over dial elements 60A. The casting of needle loops 170A and 172A off needles 54A and the casting of needle loops 174A and 176A off needles 54B having been completed, needles 54A and 54B remain withdrawn within cylinder slots 56A and 56B while dial elements 60A are withdrawn to the second position within dial slots 66A by the portion of cam track 166 indicated generally at 200, retaining and distending the pile loops 180B and 194B on the dial element hooks 63. Long dial elements 60B, which have pile loops 170B and 174B retained on yarn supporting surfaces 62B and which have been withdrawn within dial slots 66B during the above described steps, are now moved radially outwardly to the third position under the influence of the portion of cam track 168 indicated generally at 202 to advance the cutting edges 64B thereof against the pile loops 170B and 174B, thereby cutting the pile loops 170B and 174B to form cut pile ends 170C and 174C, respectively, all as shown in FIG. 22.

Again, as described above with respect to the first and second embodiments of the present invention, a presser bar 120 clamps the pile loops 170B and 174B against the serrated outer surface 116 of the dial 58 during the cutting of loops 170B and 174B. After cutting of pile loops 170B and 174B, dial elements 60B are retracted to the second position within dial slots 66B momentarily by the portion of cam track 168 indicated generally at 204 but are immediately moved radially outwardly to the first position by the portion of cam track 168 indicated generally at 206. As the retracting and subsequent outward movement of dial elements 60B occurs, long needles 54A are moved upwardly within cylinder slots 56A to their yarn receiving position by the portion of cam track 164 indicated generally at 208, needle loops 180A and 182A bearing against latches 88A during the rise of needles 54A thereby opening latches 88A and coming to rest on the upper edge 76 of the cylinder 52 about stems 78A of needles 54A as needles 54A complete their rise. Short needles 54B remain retracted within cylinder slots 56B under the influence of the portion of cam track 162 indicated generally at 210.

Figure 23:
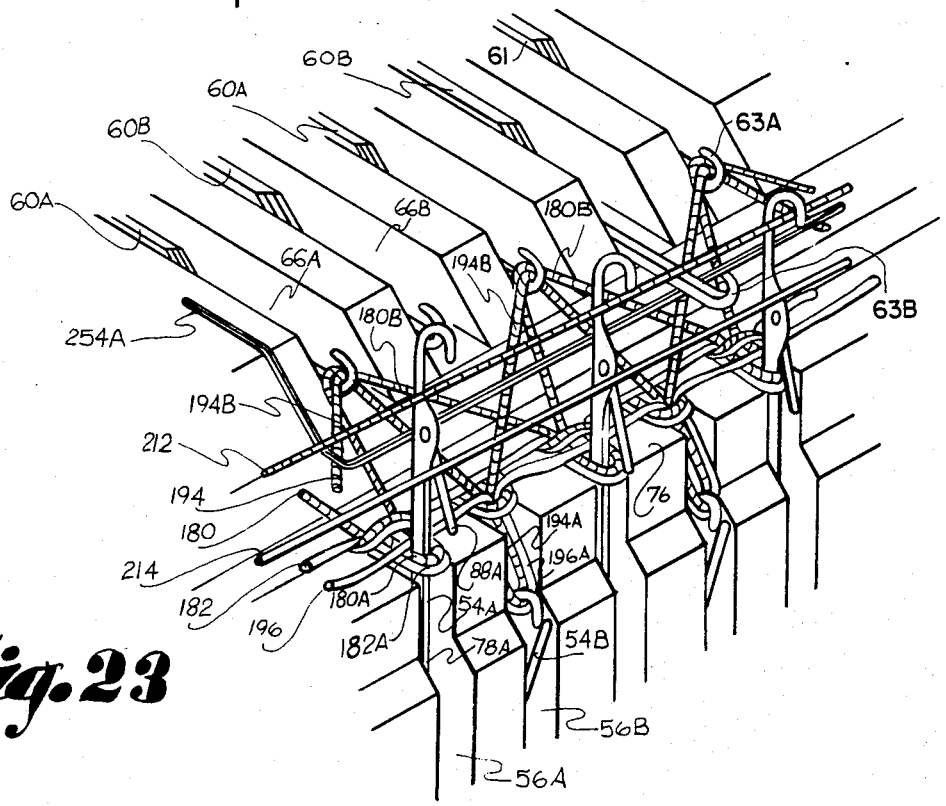
Figure 24:
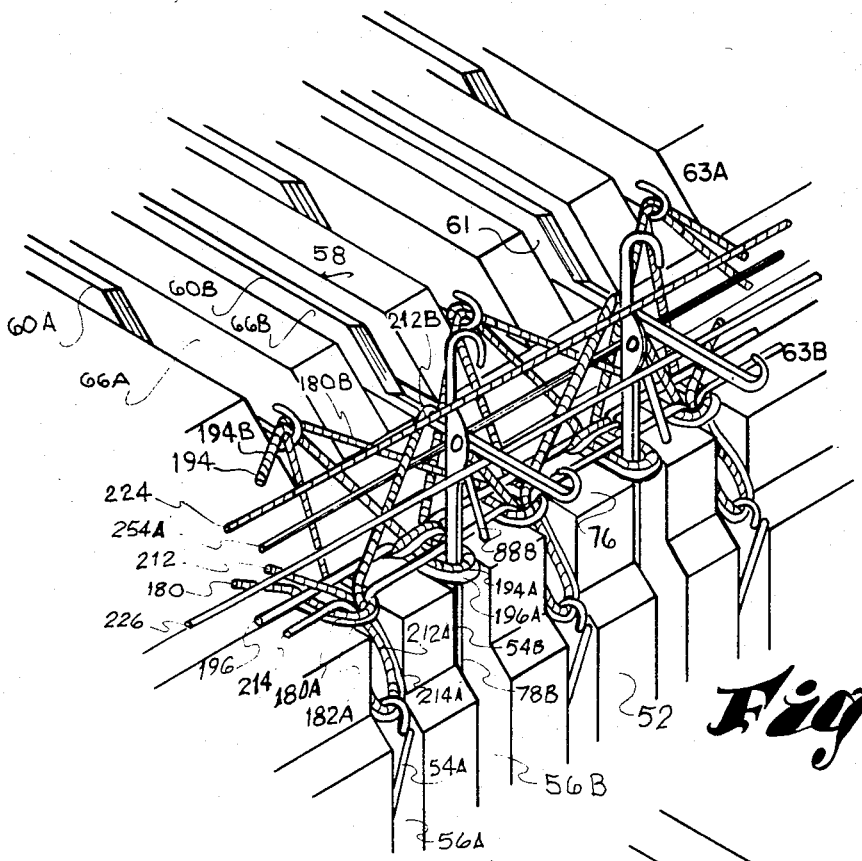
Figure 25:
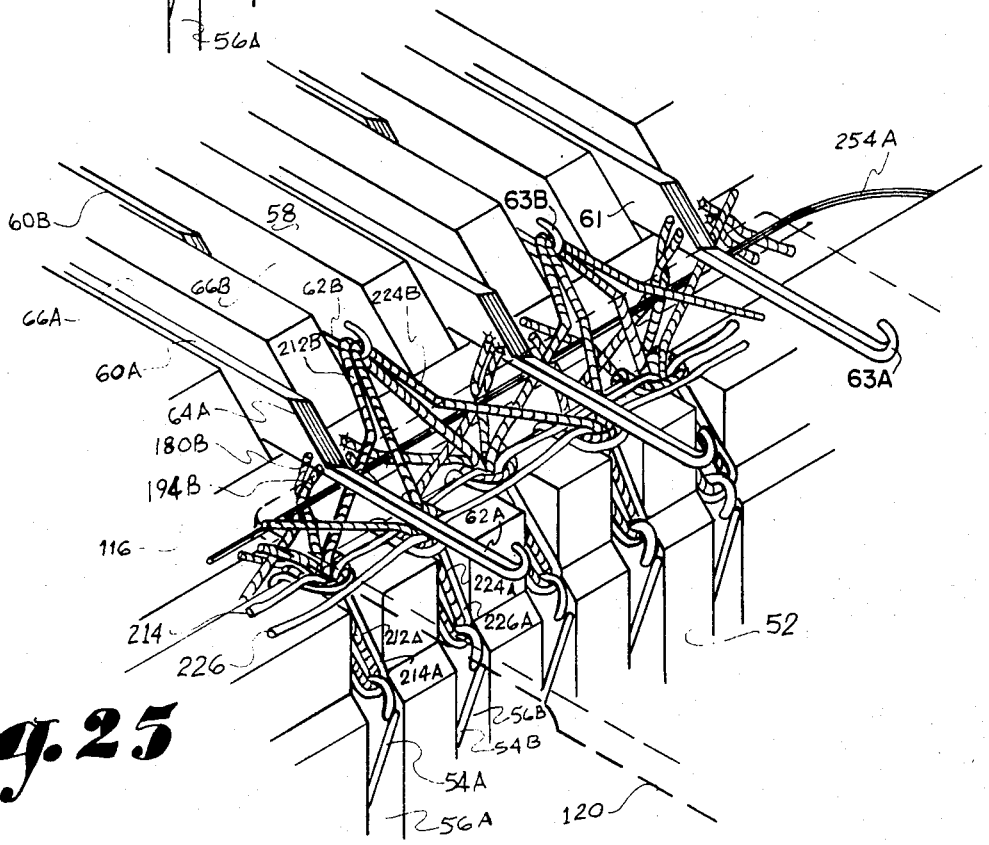

As seen in FIG. 23, a third yarn 212 for forming pile loops is fed to long needles 54A at a location above dial elements 60B while a third yarn 214 for forming fabric base loops is fed to needles 54A at a location below dial elements 60B. Needles 54A are moved downwardly within alternate cylinder slots 56A by the portion of cam track 164 indicated at 216 drawing needle loops 212A and 214A of pile loop forming yarn 212 and fabric base loop forming yarn 214, respectively, in plating relationship through needle loops 180A and 182 (as shown in FIG. 24), thereby casting off needle loops 180A and 182A, while forming third pile loops 212B over dial elements 60B. Again, long needles 54A remain withdrawn in alternate cylinder slots 56A while short needles 54B are raised to their yarn receiving position by the portion of cam track 162 indicated generally at 218, needles loops 194A and 196A bearing against latches 88B during the rise of needles 54B thereby opening latches 88B and coming to rest on the upper edge 76 of cylinder 52 about stem 78B of needles 54B. While retaining and distending the pile loops 212B on the dial element hooks 63B, long dial elements 60B are withdrawn within dial slots 66B momentarily during the downward movement of needles 54A by the portion of cam track 168 indicated generally at 220 but are immediately moved radially outwardly to the first position by the portion of cam track 168 indicated generally at 222. As seen in FIG. 24, a fourth pile loop forming yarn 224 is fed to short needles 54B at a location above dial elements 60B while a fourth fabric base loop forming yarn 226 is fed to needles 54B at a location below dial elements 60B. Needles 54B are moved downwardly within intermediate cylinder slots 56B by the portion of cam track 162 indicated at 228 drawing needle loops 224A and 226A of pile loop forming yarn 224 and fabric base loop forming yarn 226, respectively, in plating relationship through needle loops 194A and 196A (as shown in FIG. 25), thereby casting off needle loops 194A and 196A, while forming fourth pile loops 224B of pile loop forming yarn 224 over long dial elements 60B.

The casting of needle loops 180A and 182A off long needles 54A and the casting of needle loops 194A and 196A off short needles 54B having been completed, needles 54A and 54B remain withdrawn into cylinder slots 56A and 56B, respectively, while long dial elements 60B are withdrawn into dial slots 66B at the second position by the portion of cam track 168 indicated generally at 230, retaining pile loops 212B and 224B on the yarn supporting surfaces 62B thereof. Short dial elements 60A, which have pile loops 180B and 194B retained on the dial element hooks 63A thereof, are now moved radially outwardly to the third position under the influence of the portion of cam track 166 indicated at 232 to advance the cutting edges 64A thereof against the pile loops 180B and 194B, thereby cutting the pile loops 180B and 194B to form cut pile ends 180C and 194C, respectively, all as shown in FIG. 24. A presser bar 120 aids in the cutting of pile loops 180B and 194B by clamping loops 180B and 194B against the outer surface 116 of the dial 58 during the cutting thereof. After the cutting of pile loops 180B and 194B, short dial elements 60A are withdrawn into dial slots 66A momentarily by the portion of cam track 166 indicated at 234 but are immediately moved radially outwardly to the first position by the portion of cam track 166 indicated at 178, while long needles 54A rise within cylinder slots 56A to their yarn receiving position under the influence of the portion of cam track 164 indicated at 236, all in preparation for the repetition of the above described cycle.

Figure 39:
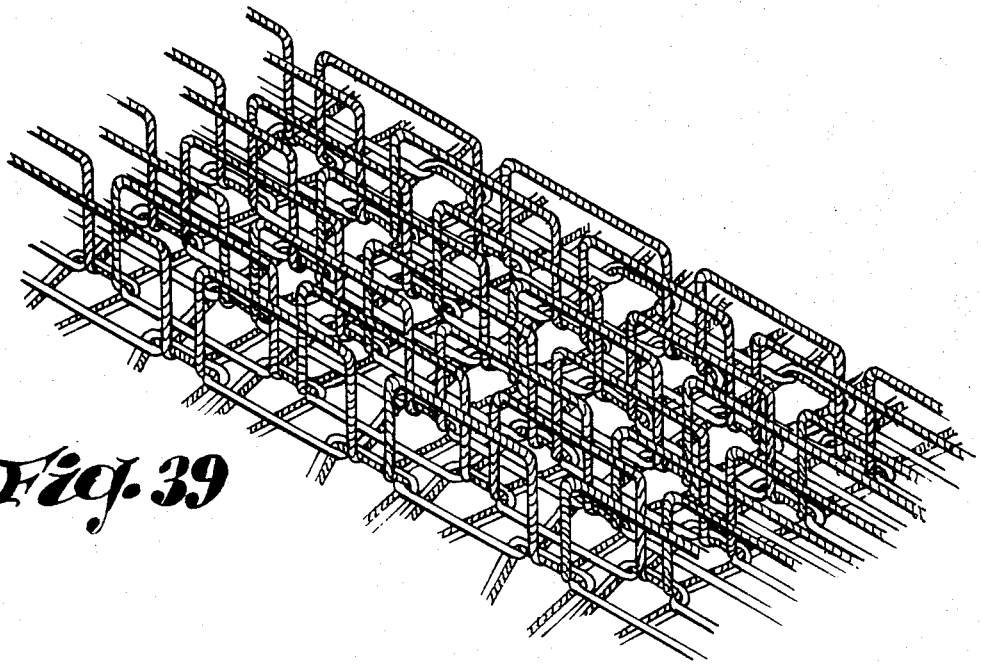
FIG. 39 is a perspective view of the fabric produced by employing the third embodiment of the present invention with the pile loops uncut.
Figure 40:
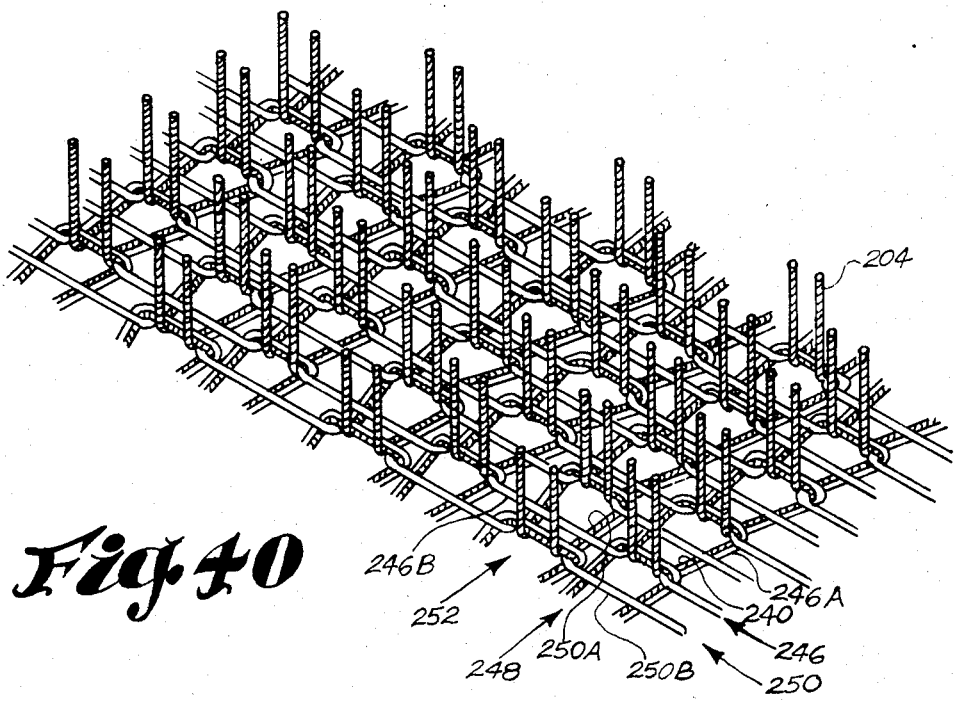
FIG. 40 is a perspective view of the fabric produced by employing the third embodiment of the present invention.
Figure 42:
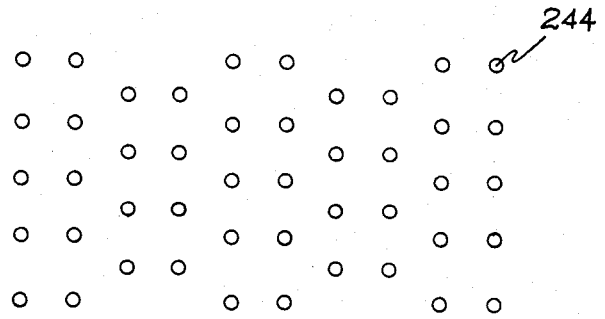
FIG. 42 is a diagrammatic view of the surface pattern of the cut pile ends of the fabric produced by employing the third embodiment of the present invention.

By employing the above described third embodiment, a new and novel cut-pile, velour-like fabric is produced, which fabric is illustrated in FIG. 40. As can be seen in FIG. 40, this plush fabric includes a base fabric which comprises a plurality of courses of fabric base loop forming yarn 238 and needle loops 240 of pile loop forming yarn 242 knit in plating relationship to each loop of the fabric base, the needle loops 240 having cut pile ends 244 projecting from each walewise side of the needle loops 240. The base fabric itself includes alternate courses 246 of yarn forming needle loops 246A which appear in alternate wales (indicated generally at 248) and forming float stitches 246B which float across intermediate wales (indicated generally at 252). The loops 246A of each alternate course 246 extend walewise beneath the float stitches 250B of an adjacent intermediate course 250 and are knit with the corresponding walewise loops 246A of an adjacent alternate course 246. The float stitches 246B of each alternate course 246 extend coursewise across the walewise loops 250A of another adjacent intermediate course 250. Extending coursewise between each adjacent pair of alternate courses 246 is an intermediate course 250 of yarn, forming needle loops 250A which appear in intermediate wales (indicated generally at 252) and which form flat stitches 250B floating across alternate wales 248. The loops 250A of each intermediate course 250 of fabric base extend walewise beneath the float stitches 246B of an adjacent alternate course 246 and are knit with the corresponding loops 250A of an adjacent intermediate course 250. The float stitches 250B of each intermediate course 250 extend coursewise across the walewise loops 246A of another adjacent alternate course 246. It can thus be seen that the alternate and intermediate courses of fabric base yarn 238, although not actually knit together in the conventional sense, are in fact interlocked together into one fabric. FIG. 39 is an illustration of a variation of the above-descirbed fabric in which the pile loops have not been cut or sheared. As described more fully above, the loops in any one course of fabric base yarn 238 appears either in alternate or intermediate wales only. This, of course, is due to the fact that only one-half of all available cylinder needles participate in the knitting of any one course of fabric in practicing the third embodiment. The surface effect produced by the cut pile ends 224 of this fabric is illustrated in FIG. 42. It is therefore apparent that, in contrast to conventional velour knitting wherein the creation of surface color effects is precluded due to the fact that the cut pile ends produced by conventional methods are always linearly aligned walewise as illustrated in FIG. 41, surface color effects or tweed effects may now be achieved in velour knitting simply by utilizing different solid color yarns for each alternate and intermediate course.

Figure 34:
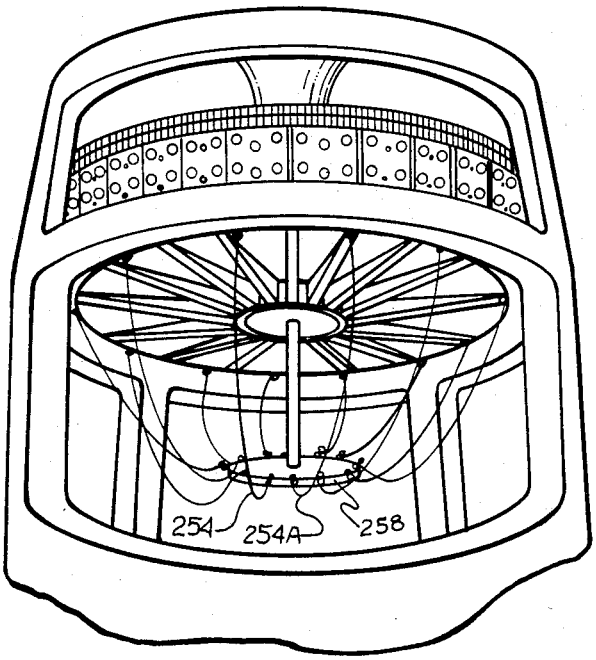
FIG. 34 is an enlarged perspective view of the central portion of the knitting machine illustrated in FIG. 1 showing part of the guiding arrangement of the present invention.

In practicing the third embodiment described above, it is preferred that means be employed for guiding the cut pile ends radially inwardly and downwardly within the needle cylinder 52 thereby directing the ends away from the needles 54 and the cylinder slots 56 and preventing the entanglement or entrapment of the cut ends in subsequently knit loops. For this purpose, a wire 254 is provided, as illustrated in FIGS. 32, 33 and 20–25. In the preferred embodiment, wire 254 is affixed to the adjustment controls of the dial cam plate 256 at a location generally adjacent the location of yarn feeding, as shown in FIGS. 32 and 33. Wire 254 passes around the outer edge of the dial as shown in FIG. 20 and extends in the direction of dial rotation circumferentially with the outer edge 116 of the dial 58 at a location immediately beneath the dial elements 60A and 60B and radially inwardly of the needles 54 but radially outwardly of the pile loops 170B and 174B formed over and retained on the withdrawn long dial elements 60B. The pile loops 180B and 194B formed over short dial elements 60A subsequently to the insertion of wire 254 are formed radially outwardly of the wire 254, as shown in FIGS. 20–22. The wire 254 extends in this disposition circumferentially with the dial 58 to a point immediately past the location of cutting of pile loops 170B and 174B, FIG. 22, and extends therefrom from radially inwardly and downwardly within the cylinder 52, wire 254 being affixed within cylinder 52 to ring 258 extending downwardly from hub 260 upon which rests the dial 58, FIG. 34. It can thus be seen that, as the dial rotates past the cutting location, FIG. 22, pile loops 170B and 174B are cut by the yarn cutting edges 64B and cut-pile ends 170C and 174C are subsequently engaged by wire 254 and guided radially inwardly of the cylinder 52, thereby preventing the entangling of cut pile ends 170C and 174C in the knitting action taking place in FIGS. 23–25. As seen in FIGS. 23–25, a second wire 254A affixed to the dial cam controls at 262, is inserted around the outer edge of the dial 58 for radially outward engagement of the pile loops 180B and 194B formed over short dial elements 60A. Wire 254A extends circumferentially with the outer surface 116 of the dial 58, immediately below the dial elements 60A and 60B and radially inwardly of the needles 54A and 54B but radially outwardly of pile loops 180B and 194B. Wire 254A extends in such disposition to a location immediately past the location at which pile loops 180B and 194B are cut and extends therefrom radially inwardly and downwardly within the needle cylinder and is also affixed to ring 258.

It can therefore be seen that the basic concept underlying the employment of the wire is to radially outwardly engage the pile loops formed over the dial elements at a point subsequent to the formation of the pile loops and to maintain such engagement during the period of retention of the pile loops over the dial elements and until the pile loops are cut, at which point the cut ends are guided radially inwardly of the cylinder and away from the needles. It is to be understood that the wire is affixed in such a manner that it remains stationary with respect to the rotating dial and cylinder just as do the dial and cylinder cams. It should therefore be noted that since the wire is inserted beneath the dial elements by passing it around the outer edge of the dial and since the dial rotates during operation, the wire must be inserted at a location where all dial elements are withdrawn within the dial. Additionally, it should be noted that the wire can engage and guide only those pile loops which will be cut at the cutting location immediately succeeding the entrance of the wire. It can therefore be seen, with respect to the third embodiment, that the most feasible location for the insertion of the wire 254 is the location shown in FIG. 20. As shown in FIG. 20 and as can be seen from FIG. 30, both dial elements 60A and 60B are withdrawn within the dial 58. Additionally, at the location of entrance of the wire shown in FIG. 20 only the pile loops 170B and 174B are retained over any of the dial elements 60A or 60B and therefore radially outward engagement of loops 170B and 174B is easily accomplished. In contrast, while wire 254 could be inserted radially outwardly of loops 170B and 174B at a location subsequent to FIG. 20 and before FIG. 21 at which point all dial elements 60A and 60B are withdrawn within the dial 58 (see the portion of cam track 166 indicated generally at 191) such would not be feasible because of the possibility of also radially outwardly engaging the pile loops 180B formed over dial elements 60A in FIG. 20. It should also be noted that if the wire used for the purpose described above is of a stiff, inflexible character, it is not necessary that wire 254 be extended within cylinder 52 and connected with ring 258; wire 162 may instead merely be crimped or bent radially inwardly of the cylinder 52 at a point immediate past the location of cutting (see FIG. 22). Finally, as illustrated in FIGS. 10–19, it should be recognized that wires 254 and 254A may be employed in practicing the second embodiment of the present invention.

Referring now to FIGS. 44–48, a sequence of views is shown progressively illustrating the action of the cylinder needles and dial cutting elements during one full knitting cycle in practicing the fourth embodiment of the present invention. Importantly and in contrast to the three above-described embodiments of the present invention, the fourth embodiment is illustrative and exemplary of the applicability of the present invention to the production of cut-pile fabric by knitting methods and apparatus wherein a pile yarn is incorporated and anchored in a base fabric other than by the plating of the pile yarn with the base yarn. Thus, in the illustrated fourth embodiment, the pile yarn is inlaid unknit in the stitches or needle loops of the base fabric. Pursuant to the fourth embodiment, a single cylinder needle 54 and a single dial element 60 are respectively provided in each cylinder and dial slot 56 and 66, as in the above-described first embodiment.

Figure 44:
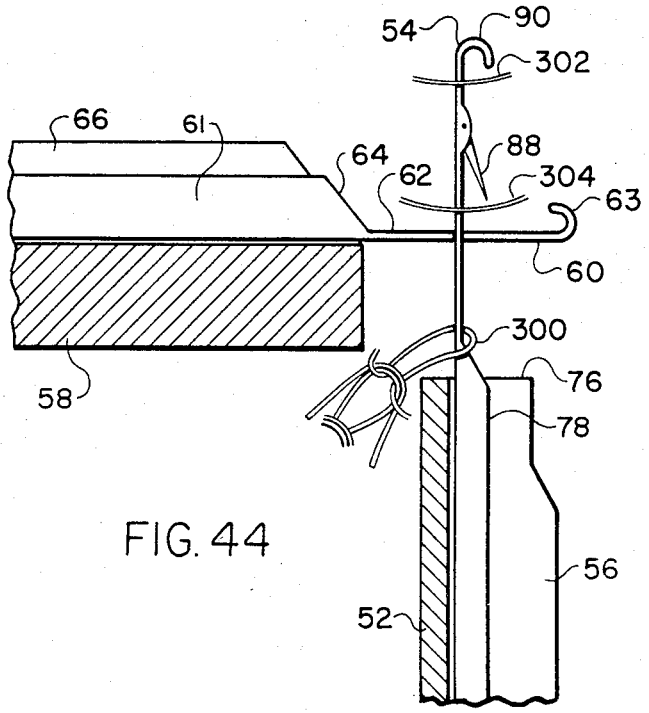
FIGS. 44–48 are schematic views sequentially illustrating in section the dial and cylinder of a circular knitting machine equipped to practice a fourth embodiment of the present invention, the views illustrating the progressive action of the knitting elements in carrying out the fourth preferred embodiment.
Figure 45:
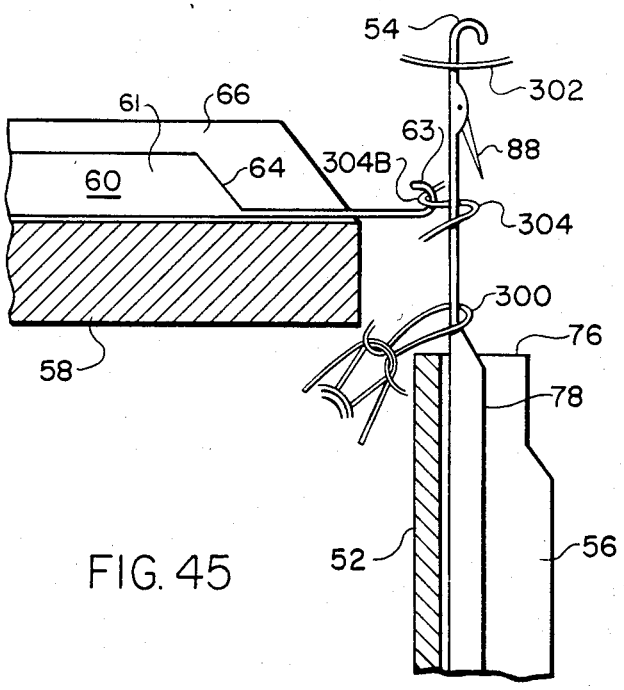
Figure 46:
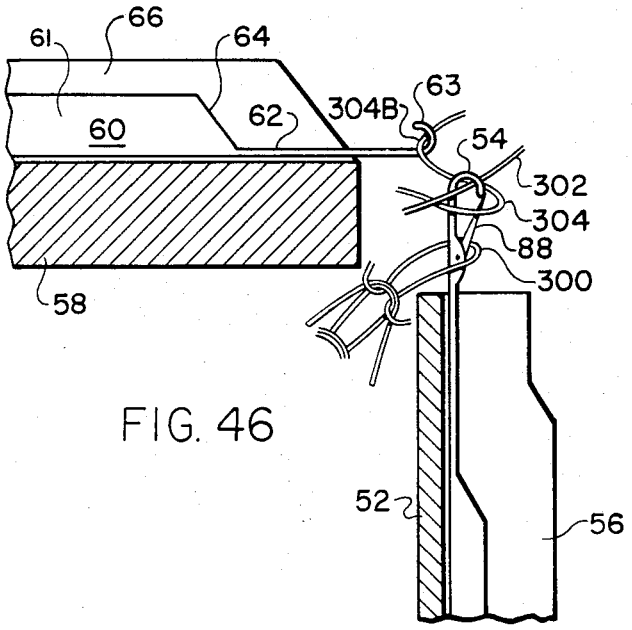
Figure 47:
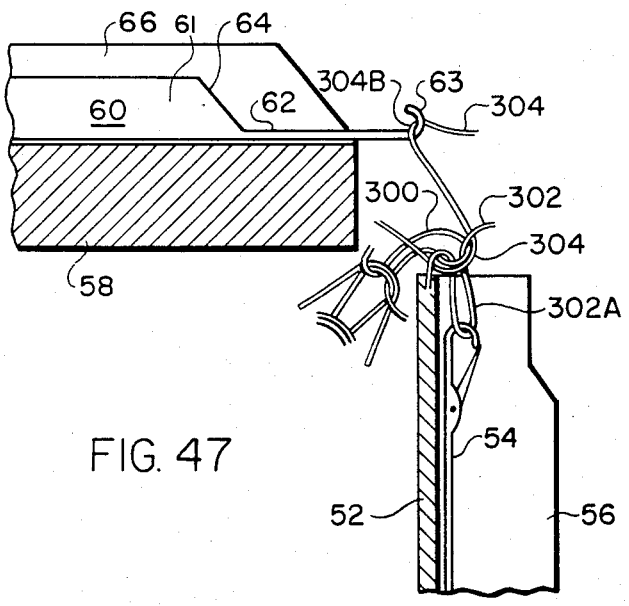
Figure 48:
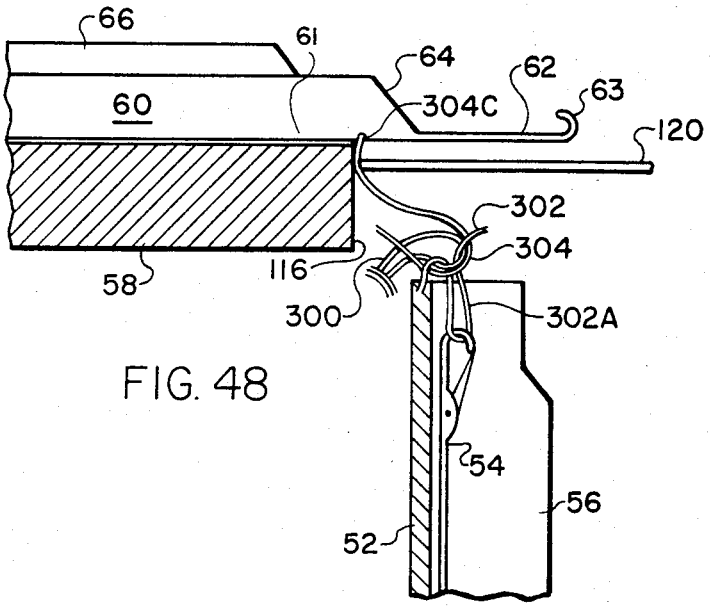

FIG. 44 illustrates the beginning of the knitting cycle of the fourth embodiment, the cylinder needles 54 being raised within cylinder slots 56 to their yarn receiving position, with the needle loops or stitches 300 of the previous course resting on the upper edge 76 of the cylinder 52 about the stems 78 of the needles 54 below the open latches 88. Dial elements 60 are positioned radially outwardly between the needles 54 at a yarn receiving position. With the needles and dial elements in this disposition a body yarn 302 is fed by conventional means into the hooks 90 of the needles 54 and a pile yarn 304 into the hooks 63 of the dial elements 60 at a level below the latches 88 of the needles 54 and adjacent the stems thereof. With the cylinder needles 54 remaining in the raised position, the dial elements 60 are then moved radially inwardly to a withdrawn position to draw the pile yarn 304 with the dial element hooks 63 taut about the stems of the needles 54 below their latches 88 and thus form and retain pile loops 304B in the hooks 63 (See FIG. 45). By thus positioning the pile yarn 304 on the needle stems 78 and below their opened latches 88, the pile yarn 304 will not be knitted with the body yarn 302, but will instead be associated with the stitches 300 of the previous course such that the pile yarn 304 and the stitches 300 will be cast off together from the needles 54, this method of feeding and incorporating a pile yarn in a body fabric being referred to as inlaying. Immediately thereafter and with the dial elements 60 remaining withdrawn, the needles 54 are withdrawn downwardly into the cylinder slots 56, the pile yarn 304 engaging and closing the needle latches 88 (FIG. 46). As the needles 54 complete their downward withdrawal, the needles 54 draw stitches 302A of the body yarn 302 through the pile yarn 304 held taut about the needle stems and through the stitches 300 of the previous course, thereby casting off the needles 54 both the pile yarn 304 and the associated stitches 300 of the previous course and anchoring the pile yarn 304 unknit in the stitches 300 beneath the coursewise extending portions of the body yarn 302. The pile yarn 304 and the stitches 300 in which it is associated and anchored being thus cast off the needles and with the needles 54 remaining downwardly withdrawn in the cylinder slots 56, the dial elements 60 are moved radially outwardly between the needles 54 beyond the yarn receiving position of FIG. 44 to advance the cutting edges 64 against the pile loops 304B which are still retained on the dial elements 60 to sever the pile loops 304B to form cut-pile ends 304C (FIG. 48). As with the above-described three embodiments, a presser bar 120 clamps the pile loops 304B against the outer serrated surface 116 of the dial 58 during the cutting to prevent movement of the pile loops relative to the cylinder 52 and its needles 54 and thereby to maintain the pile loops 304B in effective position for severance. Following the cutting of the pile loops 304B, the needles 54 are again raised to their yarn receiving position and the dial elements are returned to their first position (FIG. 44), and the described cycle is progressively and continuously repeated to form a cut-pile fabric.

Figure 49:
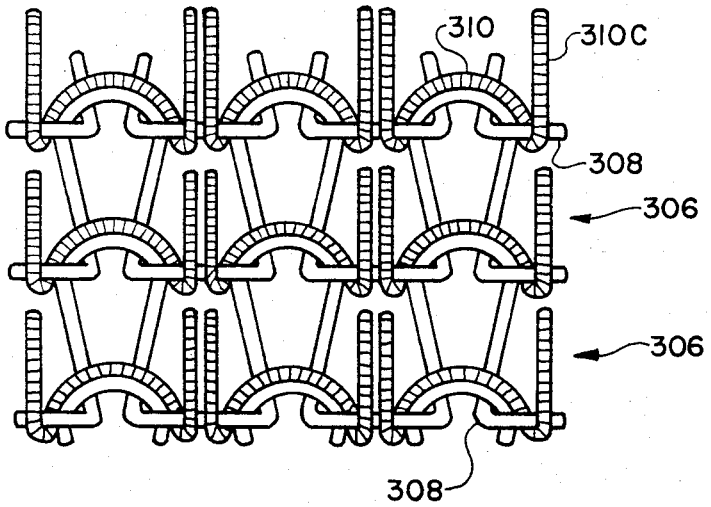
FIG. 49 is a diagrammatic view of the cut-pile fabric produced by practicing the fourth embodiment of the present invention.

The fabric produced by the above-described fourth embodiment is illustrated in FIG. 49. It will be understood by those skilled in the art that the cut-pile ends 310C actually project upwardly from the fabric, the ends 310C being illustrated as extending with the surface of the body fabric for clarity of illustration and to facilitate understanding thereof. As can be seen in such figure, the resultant fabric comprises a plurality of two-yarn courses 306, each including a fabric base or body yarn 308 knit in a single jersey stitch pattern and severed sections of a pile yarn 310 inlaid unknit in the body yarn stitches with cut-pile ends 310C extending from each walewise side of the body yarn stitches. The surface effect produced by the cut-pile ends of the fabric of FIG. 49 is denser but otherwise substantially identical to that of the conventional velour fabric of FIG. 41.

As those skilled in the art will readily understand, the above-described utilization of the present invention in inlaid pile knitting methods and apparatus is, similarly to the application of the present invention in various forms of plated knitting, susceptible of variation within the scope and substance of the present invention. For example, since the body stitches of the inlaid pile fabric of the above-described fourth embodiment are formed of only the body yarn 302 rather than of two plated yarns, it is possible to form the body stitches in inlaid pile fabric much more tightly and closely than in plated pile knitting and, accordingly, it is contemplated that the pile loops 304B formed in several successive yarn feeding stations may be maintained on the dial elements 60 through each of the feeds and subsequently severed after casting-off has occurred with one radially outward manipulation of the dial elements 60, all without deleteriously affecting the structure of the stitches and pile loops of the earliest formed course. Radially outward cutting manipulation of the dial elements 60 following every third or fourth feed is considered optimum and advantageously reduces dulling of the cutting edges 64 of the dial elements 60 while also facilitating increased knitting speed and fabric output.

It additionally is presently considered to be good practice according to the present invention to delay the severance of pile loops in inlaid pile knitting, such as the fourth embodiment above, at least until after one additional fabric course has been formed on the needles 54 following the casting-off of the pile yarn and the body stitches in which it is anchored. Thus, further embodiments of the present invention utilizing inlaid pile knitting methods and apparatus and corresponding to the above-described three embodiments of the present invention utilizing plated knitting methods and apparatus are possible. For example, a succeeding course or courses of body yarn stitches may be knitted in the fourth embodiment above following the casting-off occurring in FIG. 47 and prior to the cutting occurring in FIG. 48. Alternatively, each dial slot 66 may be provided with both a long and short dial element 60A and 60B as in the second embodiment above, with pile loops being formed according to the inlaid pile method of the fourth embodiment at one feed over one dial element of each dial element pair and at the succeeding feed over the other dial element of each pair followed by the cutting manipulation of the one dial element of each pair to cut the first formed pile loops. Further, the dial and cylinder slots may be provided with alternating long and short needles and dial elements as in the above-described third embodiment with alternate and intervening needles and dial elements being respectively operated for pile loop formation at alternate and intervening yarn feeding stations to form a staggered pile arrangement. As will be understood, the severance of pile loops formed and cast-off during any one feeding cycle can be performed immediately after casting-off of the pile yarn or delayed as desired. It is to be understood that these embodiments together with the four embodiments illustrated and described above and all other embodiments are considered to be part of the present invention which is to be limited only by the appended claims.

It will therefore be understood that, in each embodiment of the present invention, the pile loop forming yarn is associated and incorporated with stitches of the body yarn and both the pile yarn and its associated body yarn stitches are cast off the needles to anchor the pile yarn in the body yarn stitches, prior to the manipulation of the dial elements on which pile loops of the pile yarn are formed to cut the pile loops. Thus, according to the present invention, it is only after the pile yarn has been actually incorporated into the fabric and it and the body yarn stitches with which it is associated have been removed completed from the needles so that subsequent needle manipulation cannot affect the pile yarn, that the pile loops of the pile yarn are cut. With regard to any particular fabric stitch and the pile yarn associated therein, the knitting process is complete at the point of casting-off of the stitch and associated pile yarn. Further, the pile loops have been retained on the dial elements and distended thereby throughout these steps to insure proper pile loop formation and control. In this manner, therefore, the shifting, spreading, or loss of some length of the cut-pile ends into the base fabric which could be caused by the further manipulation of the needles if the pile loops were cut prior to casting off is prevented, while also assuring and enhancing the proper anchoring of the pile yarn in the base fabric and the optimum positioning and projection of the pile ends in the finished fabric.

Further advantages also result from the present invention. Thus, by performing the cutting operation during the knitting process and severing the pile loops at the crest thereof, the two-fold effect is achieved of eliminating the need for certain finishing operations such as shearing, or at least minimizing the extent thereof, and thereby substantially reducing the amount of fiber and yarn waste. Moreover, as explained more fully above, the present invention readily facilitates the use of a wide variety of yarns and stitch patterns not conventionally employed in cut-pile fabric formation. The applicability of the present invention to inlaid pile fabric knitting provides additional economies in reducing the amount of pile yarn incorporated in the base fabric and thereby permitting the more efficient utilization of the pile yarn. As a result, a more expensive, denser pile yarn can be utilized without increasing the cost of production.

Although the present invention has been described in relation to the preferred embodiments, it is to be understood that modifications and variations may be resorted to without departing from the substance or scope of the present invention as those skilled in the art will readily understand. Such modifications and variations are within the scope of the present invention, which is intended to be limited only by the appended claims and equivalents thereof.

We claim:

1. Independently movable one-piece pile loop forming and cutting elements adapted to longitudinally reciprocate transversely of and to cooperate with an intercalated circle of independently lengthwise movable latch knitting needles flanking each element with a pair of said needles for the formation of cut-pile jersey fabric having needle and sinker wales of a body yarn with cut-pile loops of a pile yarn incorporated therein, each of said elements comprising a lengthwise extending body member having an open sided yarn engaging hook at an end thereof, having a yarn cutting edge spaced from and facing the open side of said hook, and having a yarn supporting surface extending lengthwise therebetween for drawing by said needles of uncut sinker wale loops of said pile yarn over and for supporting of said loops on said surface, said hook, cutting edge and yarn supporting surface of each of said elements being so arranged that during said reciprocating movements of said elements transversely of said needles said yarn supporting surfaces of said elements extend normal to said needles, said elements being movable transversely of said needles to three positions relative to said pile yarn formed thereon, said positions including a middle position wherein said pile yarn is drawn by said needles into said sinker wale loops over said yarn supporting surfaces and said loops are supported thereon, one position moved longitudinally in one transverse direction from said middle position wherein said hooks engage, distend and retain said sinker wale loops, and another position moved longitudinally in the opposite transverse direction from said middle position wherein said cutting edges sever said sinker wale loops to free said elements of said sinker wale loops and to provide cut pile ends of said pile yarn in said fabric.

2. Independently movable pile loop forming and cutting elements according to claim 1 and characterized further in that said yarn engaging hook, said yarn supporting surface, and said yarn cutting edge are formed on one longitudinally extending surface of said body member.

3. Independently movable pile loop forming and cutting elements according to claim 2 and characterized further in that said one surface includes a shoulder in facing relation to said open side of said hook, said yarn cutting edge being formed along said shoulder.

4. Independently movable pile loop forming and cutting elements according to claim 1 and characterized further in that said elements are dial elements adapted for disposition in the dial of a circular knitting machine of the dial and cylinder type, each said dial element having its hook radially outward of its yarn supporting surface and of its yarn cutting edge for retaining pile loops when said element is moved radially inwardly, and having its yarn cutting edge radially inward of its yarn retaining hook and of its yarn supporting surface for severing pile loops when said element is moved radially outwardly.

5. A movable one-piece pile loop forming and cutting element comprising a lengthwise extending body member having an open sided yarn engaging hook at an end thereof, having a yarn cutting edge spaced from and facing the open side of said hook, and having a yarn supporting surface extending lengthwise therebetween for drawing of an uncut loop of pile yarn over and for supporting of said loop on said surfaces, said element being movable to three positions relative to said yarn thereto, said positions including a middle position wherein said yarn is drawn into said pile yarn loop over and is supported on said surface, one position moved longitudinally in one direction from said middle position wherein said hook engages, distends and retains said pile yarn loop, and another position moved longitudinally in the opposite direction from said middle position wherein said cutting edge severs said pile yarn loop to free said element of said loop and to provide cut pile ends of said yarn.

6. A plurality of pile loop forming and cutting elements according to claim 5 arranged in a circular series for independent movement and intercalated with a circular series of independently transversely movable latch needles with a pair of said needles flanking each said element, said yarn being drawn in said pile yarn loops over said elements by their respective pairs of said needles.

* * * * *

UNITED STATES PATENT OFFICE

CERTIFICATE OF CORRECTION

Patent No. 4,537,048 Dated August 27, 1985

Inventor(s) Alan Gutschmidt and Paul W. York

It is certified that error appears in the above-identified patent and that said Letters Patent are hereby corrected as shown below:

Column 10, Line 35, after "moved" insert -- radially -- .

Column 10, Line 45, delete "three" and insert therefor -- four -- .

Column 10, Line 64, after "track" insert -- 70 -- .

Column 17, Line 29, delete "flat" and insert therefor -- float -- .

Column 18, Line 16, after "therefrom" delete -- from -- .

Column 21, Line 23, after "each" insert -- such -- .

Column 24, Line 3, after "said", third occurrence thereof, change "surfaces" to -- surface -- .

Column 24, Line 5, delete "thereto" and insert therefor -- thereon -- .

Signed and Sealed this

*Fourth* Day of *March 1986*

[SEAL]

*Attest:*

DONALD J. QUIGG

*Attesting Officer* *Commissioner of Patents and Trademarks*